US006458524B1

(12) United States Patent
Nakamura et al.

(10) Patent No.: US 6,458,524 B1
(45) Date of Patent: Oct. 1, 2002

(54) SILVER HALIDE PHOTOGRAPHIC LIGHT-SENSITIVE MATERIAL

(75) Inventors: Tetsuo Nakamura; Kimiyasu Morimura, both of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/643,717

(22) Filed: Aug. 23, 2000

(30) Foreign Application Priority Data

Aug. 31, 1999 (JP) ..... 11-246122

(51) Int. Cl.[7] ..... G03C 1/005; G03C 1/494

(52) U.S. Cl. ..... 430/584; 430/583; 430/582; 430/581; 430/570

(58) Field of Search ..... 430/584, 583, 430/582, 581, 570

(56) References Cited

U.S. PATENT DOCUMENTS

| | | | | |
|---|---|---|---|---|
| 5,290,676 A | | 3/1994 | Nagaoka et al. | |
| 5,437,972 A | * | 8/1995 | Ikegawa et al. | 430/574 |
| 5,464,734 A | * | 11/1995 | Inagaki et al. | 430/585 |
| 5,464,735 A | * | 11/1995 | Preddy et al. | 430/585 |
| 5,604,089 A | * | 2/1997 | Ikegawa et al. | 430/584 |
| 6,010,842 A | * | 1/2000 | Suga et al. | 430/588 |

FOREIGN PATENT DOCUMENTS

JP 200063689 2/2000

* cited by examiner

*Primary Examiner*—Geraldine Letscher
(74) *Attorney, Agent, or Firm*—Birch, Stewart, Kolasch & Birch, LLP

(57) ABSTRACT

A silver halide photographic light-sensitive material is described, comprising at least one compound represented by the following formula (I):

(I)

$(M)_m$ wherein $Z_1$ and $Z_2$ each represents oxygen atom, sulfur atom, selenium atom, tellurium atom or a >NR group, R represents an alkyl group, an aryl group or a heterocyclic group, $L_1$, $L_2$ and $L_3$ each represents a methine group, $n_1$ represents 0 1, 2 or 3, $V_1$, $V_2$, $V_3$, $V_4$, $W_1$, $W_2$, $W_3$ and $W_4$ each represents hydrogen atom or a substituent, provided that two substituents may be combined with each other to form a condensed ring on the condition that assuming the sum total of π values of the substituents $V_1$ to $V_4$ is $\pi_v$ and the sum total of π values of the substituents $W_1$ to $W_4$ is $\pi_w$, either one of $\pi_v$ and $\pi_w$ is 0.70 or less, M represents a charge-balancing counter ion, m represents a number necessary for neutralizing the electric charge of the molecule, $R_1$ represents an alkyl group, an aryl group or a heterocyclic group, and $R_2$ represents a substituent represented by any of the following formulae:

$$-(L_a)_{ka}CONHSO_2R_a$$

$$-(L_b)_{kb}SO_2NHCOR_b$$

$$-(L_c)_{kc}CONHCOR_c$$

$$-(L_d)_{kd}SO_2NHSO_2R_d$$

$$-(L_e)_{ke}COOH$$

wherein $R_a$, $R_b$, $R_c$ and $R_d$ each represents an alkyl group, an aryl group, a heterocyclic group, an alkoxy group, an aryloxy group, a heterocyclyloxy group or an amino group, $L_a$, $L_b$, $L_c$, $L_d$ and $L_e$ each represents a methylene group, and $k_a$, $k_b$, $k_c$, $k_d$ and $k_e$ each represents an integer of 1 or more.

7 Claims, No Drawings

SILVER HALIDE PHOTOGRAPHIC LIGHT-SENSITIVE MATERIAL

FIELD OF THE INVENTION

The present invention relates to a silver halide photographic light-sensitive material containing a novel compound, more specifically, the present invention relates to a silver halide photographic light-sensitive material having high sensitivity and reduced in the residual color.

BACKGROUND OF THE INVENTION

Heretofore, a great deal of efforts have been made to increase the sensitivity of silver halide photographic light-sensitive materials and reduce the persistent coloring (residual color or dye stain). Sensitizing dyes used for the spectral sensitization are known to have great effect on the capabilities of a silver halide photographic light-sensitive material. A slight difference in the structure of sensitizing dyes greatly affects the photographic capabilities such as sensitivity, fog, storage stability and residual color, however, this effect cannot be easily anticipated in advance. Therefore, many researchers have conventionally labored to synthesize a large number of sensitizing dyes and examine the photographic capabilities thereof.

The silver halide tabular grain (hereinafter referred to as a "tabular grain") has the following photographic properties:

1) the ratio of the surface area to the volume is large and a large amount of a sensitizing dye can be adsorbed to the surface, so that higher spectral sensitization sensitivity can be obtained;
2) when an emulsion containing tabular grains is coated and dried, the grains orient in parallel to the support surface, so that the coated layer can be reduced in the thickness and good sharpness can be obtained;
3) the tabular grains oriented in parallel to the support maintain their shape and orientation after the development, so that the developed silver can exhibit high covering power; by virtue of this property, particularly in the case of an X-ray film, the coated silver amount necessary for obtaining an optical density of the same level as otherwise can be reduced;
4) the tabular grains oriented in parallel to the support reduce the light scattering, so that an image having high resolution can be obtained; and
5) the sensitivity to blue light is low, so that when the silver halide tabular grain is used in a green- or red-sensitive layer, a yellow filter can be reduced or dispensed with.

U.S. Pat. No. 4,439,520 describes a color photographic light-sensitive material improved in the sharpness, sensitivity and graininess by using a tabular grain having a thickness of less than 0.3 μm, a diameter of 0.6 μm or more and an aspect ratio of 8 or more in at least one of the green-sensitive emulsion layer and the red-sensitive emulsion layer. The aspect ratio as used herein means a ratio of the diameter of a tabular grain to the thickness. The diameter of a tabular grain as used herein means a diameter of a circle having the same area as the projected area of a grain when the emulsion is observed through a microscope or an electron microscope. The thickness as used herein is a distance between two parallel planes constituting a tabular grain.

U.S. Pat. No. 4,693,964 describes a photographic element containing silver bromide or silver iodobromide tabular grains having an average diameter of from 0.4 to 0.55 μm and an aspect ratio of 8 or more, where a tabular grain having an average diameter of 0.5 μm and a thickness of 0.04 μm is disclosed in the Examples. U.S. Pat. No. 4,672,027 describes a photographic element containing silver bromide or silver iodobromide tabular grains having an average diameter of from 0.22 to 0.55 μm and an aspect ratio of 8 or more, where a tabular grain having a thickness of 0.04 μm is disclosed in the Examples.

U.S. Pat. No. 5,250,403 describes a color photographic element containing tabular grains having a (111) main plane, an average diameter of 0.7 μm or more and an average thickness of less than 0.07 μm in a minus blue (green and/or red) layer. Tabular grains having an average thickness of less than 0.07 μm are called an "ultra-thin" tabular grain. In this patent publication, it is stated that the ultra-thin tabular grain emulsion is advantageous in view of the relationship between the sensitivity and the graininess and that this emulsion is preferably used in a color photographic element, particularly, in a minus blue recording emulsion layer, because an image having good sharpness can be obtained.

European Patent 362699 describes a tabular grain in which the ratio of the aspect ratio to the diameter of a tabular grain is larger than 0.7, where a tabular grain having a thickness of 0.04 μm is prepared in the Examples.

As such, investigations have been heretofore concentrated on the development of tabular grains having a higher aspect ratio and a smaller thickness so as to bring out the characteristic properties of the tabular grain to a higher extent. However, requirements for higher quality photographs are strong and development of techniques for achieving still higher sensitivity is keenly demanded.

As described above, the tabular grain is large in the ratio of the surface area to the volume, therefore, a large amount of a sensitizing dye can be adsorbed to the surface and thereby a higher spectral sensitization sensitivity can be obtained. Here, it is considered that by increasing the photoabsorption factor of a sensitizing dye, the efficiency in the transmission of light energy to silver halide can be increased and in turn higher spectral sensitivity can be attained.

In this way, the tabular grain is advantageous for obtaining a high spectral sensitization sensitivity but has a problem in that due to adsorption of a sensitizing dye in a large amount, the residual color after the processing increases. Thus, it is demanded to solve this problem.

From these reasons, studies are being made for a sensitizing dye having high sensitivity and reduced in the residual color.

SUMMARY OF THE INVENTION

The object of the present invention is to provide a silver halide light-sensitive material having high sensitivity and excellent storage stability and reduced in the fogging and the residual color.

As a result of extensive investigations, the object of the present invention can be attained by the following means:

(1) a silver halide photographic light-sensitive material comprising a support having provided thereon at least one emulsion layer containing silver halide grains, which comprises at least one compound represented by the following formula (I):

(I)

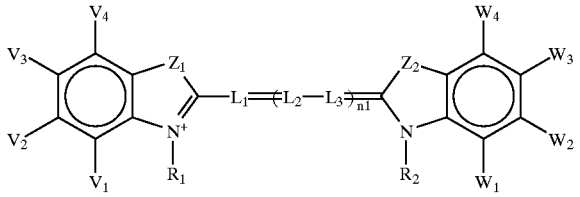

$(M)_m$ wherein $Z_1$ and $Z_2$ each represents oxygen atom, sulfur atom, selenium atom, tellurium atom or a >NR group (wherein R represents an alkyl group, an aryl group or a heterocyclic group), $L_1$, $L_2$ and $L_3$ each represents a methine group, $n_1$ represents 0, 1, 2 or 3, $V_1$, $V_2$, $V_3$, $V_4$, $W_1$, $W_2$, $W_3$ and $W_4$ each represents hydrogen atom or a substituent, provided that two substituents may be combined with each other to form a condensed ring on the condition that assuming the sum total of π values of the substituents $V_1$ to $V_4$ is $\pi_v$ and the sum total of π values of the substituents $W_1$ to $W_4$ is $\pi_w$, either one of $\pi_v$ and $\pi_w$ is 0.70 or less, M represents a charge-balancing counter ion, m represents a number necessary for neutralizing the electric charge of the molecule, $R_1$ represents an alkyl group, an aryl group or a heterocyclic group, and $R_2$ represents a substituent represented by any of the following formulae:

$—(L_a)_{ka}CONHSO_2R_a$ $—(L_b)_{kb}SO_2NHCOR_b$ $—(L_c)_{kc}CONHCOR_c$ $—(L_d)_{kd}SO_2NHSO_2R_d$ $—(L_e)_{ke}COOH$ wherein $R_a$, $R_b$, $R_c$ and $R_d$ each represents an alkyl group, an aryl group, a heterocyclic group, an alkoxy group, an aryloxy group, a heterocyclyloxy group or an amino group, $L_a$, $L_b$, $L_c$, $L_d$ and $L_e$ each represents a methylene group, and $k_a$, $k_b$, $k_c$, $k_d$ and $k_e$ each represents an integer of 1 or more;

(2) the silver halide photographic light-sensitive material as described in (1), wherein the sum of $\pi_v$ and $\pi_w$ is 1.40 or less;

(3) the silver halide photographic light-sensitive material as described in (1) or (2), wherein either one of $\pi_v$ and $\pi_w$ is 0.70 or more and the other is 0.70 or less;

(4) the silver halide photographic light-sensitive material as described in (3), wherein $\pi_v$ is 0.70 or less and $\pi_w$ is 0.70 or more;

(5) the silver halide photographic light-sensitive material as described in (4), wherein $\pi_v$ is from 0.00 to 0.70 and $\pi_w$ is 0.70 to 1.40;

(6) the silver halide photographic light-sensitive material as described in (1), wherein the substituent $R_2$ in the compound represented by formula (I) is $—(L_e)_{ke}COOH$;

(7) the silver halide photographic light-sensitive material as described in (6), wherein the compound represented by formula (I) is a compound represented by the following formula (II):

(II)

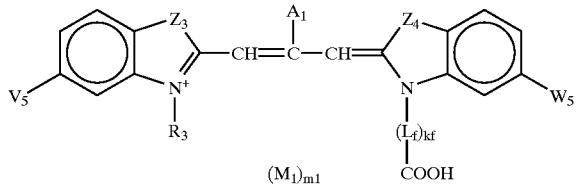

$(M_1)_{m1}$ wherein $Z_3$ and $Z_4$ each represents oxygen atom or sulfur atom, $A_1$ represents hydrogen atom or an alkyl group, either one of $V_5$ and $W_5$ is a substituent selected from the group consisting of chlorine atom, bromine atom, iodine atom, a trifluoromethyl group, an ethyl group, a benzoyl group and a 1-pyrrolyl group, and the other is a substituent selected from the group consisting of hydrogen atom, fluorine atom, a methyl group, a methylthio group, an ethoxy group, an ethoxycarbonyl group, a 2-pyridyl group and a 4-pyridyl group, $M_1$ represents a charge-balancing counter ion, $m_1$ represents a number necessary for neutralizing the electric charge of the molecule, $R_3$ represents an alkyl group having a sulfo group as a substituent, $L_f$ represents a methylene group, and $k_f$ represents an integer of from 1 to 3;

(8) the silver halide photographic light-sensitive material as described in (1), wherein the substituent $R_2$ in the compound represented by formula (I) is a substituent selected from the group consisting of $—(L_a)_{ka}CONHSO_2R_a$, $—(L_b)_{kb}SO_2NHCOR_b$, $—(L_c)_{kc}CONHCOR_c$ and $—(L_d)_{kd}SO_2NHSO_2R_d$;

(9) the silver halide photographic light-sensitive material as described in (8), wherein the compound represented by formula (I) is a compound represented by the following formula (III):

(III)

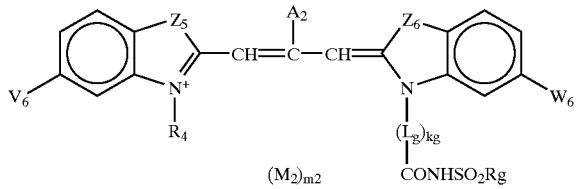

$(M_2)_{m2}$ wherein $Z_5$ and $Z_6$ each represents oxygen atom or sulfur atom, $A_2$ represents hydrogen atom or an alkyl group, $V_6$ represents a substituent selected from the group consisting of hydrogen atom, fluorine atom, a methyl group, a methylthio group, an ethoxy group, an ethoxycarbonyl group, a 2-pyridyl group and a 4-pyridyl group, $W_6$ represents a substituent selected from the group consisting of chlorine atom, bromine atom, iodine atom, a trifluoromethyl group, an ethyl group, a benzoyl group and a 1-pyrrolyl group, $M_2$ represents a charge-balancing counter ion, $m_2$ represents a number necessary for neutralizing the electric charge of the molecule, $R_4$ represents an alkyl group having a sulfo group as a substituent, $R_g$ represents an alkyl group, $L_g$ represents a methylene group, and $k_g$ represents an integer of from 1 to 3; and

(10) the silver halide photographic light-sensitive material as described in (1), (2), (3), (4), (5), (6), (7), (8) or (9), wherein at least one compound represented by formula (I), (II) or (III) is contained and the emulsion layer containing the compound is formed of silver halide grains having an average aspect ratio of from 3 to 100.

DETAILED DESCRIPTION OF THE INVENTION

The compound represented by formula (I) for use in the present invention is described in detail below.

$Z_1$ and $Z_2$ each represents oxygen atom, sulfur atom, selenium atom, tellurium atom or a >NR group, R represents an alkyl group, an aryl group or a heterocyclic group, and $R_1$ represents an alkyl group, an aryl group or a heterocyclic group.

Examples of the alkyl group represented by R or $R_1$ include an unsubstituted alkyl group having from 1 to 8, preferably from 1 to 4, carbon atoms (e.g., methyl, ethyl, propyl, isopropyl, butyl, isobutyl, hexyl), and an alkyl group having from 1 to 8, preferably from 1 to 4, carbon atoms, which is substituted by V described below {examples of V include a halogen atom (e.g., chlorine, bromine, iodine, fluorine), a mercapto group, a cyano group, a carboxyl group, a phosphoric acid group, a sulfo group, a hydroxy group, a carbamoyl group having from 1 to 7, preferably from 2 to 5, more preferably from 2 to 3, carbon atoms (e.g., methylcarbamoyl, ethylcarbamoyl, morpholinocarbonyl), a sulfamoyl group having from 0 to 7, preferably from 2 to 5, more preferably from 2 to 3 carbon atoms (e.g., methylsulfamoyl, ethylsulfamoyl, piperidinosulfonyl), a nitro group, an alkoxy group having from 1 to 7, preferably from 1 to 5, more preferably from 1 to 3, carbon atoms (e.g., methoxy, ethoxy, 2-methoxyethoxy, 2-phenylethoxy), an aryloxy group having from 6 to 7 carbon atoms (e.g., phenoxy, p-methylphenoxy, p-chlorophenoxy), an acyl group having from 1 to 7, preferably from 2 to 5, more preferably from 2 to 3, carbon atoms (e.g., acetyl, benzoyl, trichloroacetyl), an acyloxy group having from 1 to 7, preferably from 2 to 5, more preferably from 2 to 3, carbon atoms (e.g., acetyloxy, benzoyloxy), an acylamino group having from 1 to 7, preferably from 2 to 5, more preferably from 2 to 3, carbon atoms (e.g., acetylamino), a sulfonyl group having from 1 to 7, preferably from 1 to 5, more preferably from 1 to 3, carbon atoms (e.g., methanesulfonyl, ethanesulfonyl, benzenesulfonyl), a sulfinyl group having from 1 to 7, preferably from 1 to 5, more preferably from 1 to 3, carbon atoms (e.g., methanesulfinyl, benzenesulfinyl), a sulfonylamino group having from 1 to 7, preferably from 1 to 5, more preferably from 1 to 3, carbon atoms (e.g., methanesulfonylamino, ethanesulfonylamino, benzenesulfonylamino), an amino group, a substituted amino group having from 1 to 7, preferably from 1 to 5, more preferably from 1 to 3, carbon atoms (e.g,., methylamino, dimethylamino, benzylamino, anilino), an ammonium group having from 0 to 7, preferably from 0 to 5, more preferably from 0 to 3, carbon atoms (e.g., trimethylammonium, triethylammonium), a hydrazino group having from 0 to 7, preferably from 1 to 5, more preferably from 1 to 3, carbon atoms (e.g., trimethylhydrazino), a ureido group having from 1 to 7, preferably from 1 to 5, more preferably from 1 to 3, carbon atoms (e.g., ureido, N,N-dimethylureido), an imido group having from 1 to 7, preferably from 1 to 5, more preferably from 1 to 3, carbon atoms (e.g., succinimido), an alkyl- or aryl-thio group having from 1 to 7, preferably from 1 to 5, more preferably from 1 to 3, carbon atoms (e.g., methylthio, ethylthio, carboxyethylthio, sulfobutylthio, phenylthio), an alkoxycarbonyl group having from 2 to 7, preferably from 2 to 5, more preferably from 2 to 3, carbon atoms (e.g., methoxycarbonyl, ethoxycarbonyl, benzyloxycarbonyl), an aryloxycarbonyl group having from 6 to 7 carbon atoms (e.g., phenoxycarbonyl), an unsubstituted alkyl group having from 1 to 7, preferably from 1 to 5, more preferably from 1 to 3, carbon atoms (e.g., methyl, ethyl, propyl, butyl), a substituted alkyl group having from 1 to 7, preferably from 1 to 5, more preferably from 1 to 3, carbon atoms (e.g., hydroxymethyl, trifluoromethyl, benzyl, carboxyethyl, ethoxycarbonylmethyl, acetylamino-methyl; the substituted alkyl group as used herein also includes an unsaturated hydrocarbon group preferably having from 2 to 7, more preferably from 2 to 5, still more preferably from 2 to 3, carbon atoms (e.g., vinyl, ethynyl, 1-cyclohexenyl, benzylidine, benzylidene)), a substituted or unsubstituted aryl group having from 6 to 7 carbon atoms (e.g., phenyl, p-carboxyphenyl, p-nitrophenyl, 3,5-dichlorophenyl, p-cyanophenyl, m-fluorophenyl, p-tolyl) and a heterocyclic group having from 1 to 7, preferably from 2 to 5, carbon atoms (e.g., pyridyl, 5-methylpyridyl, thienyl, furyl, morpholino, tetrahydrofurfuryl); two of these substituents may be combined with each other to have a structure where a benzene ring, a naphthalene ring, an anthracene ring or a heterocyclic ring is condensed; these substituents each may be further substituted by V thereon}.

Examples of the aryl group represented by R or $R_1$ include an unsubstituted aryl group having from 6 to 20, preferably from 6 to 10, more preferably from 6 to 8, carbon atoms (e.g., phenyl, 1-naphthyl), and a substituted aryl group having from 6 to 20, preferably from 6 to 10, more preferably from 6 to 8, carbon atoms (e. g., the above-described aryl group substituted by V, specifically, p-methoxyphenyl group, p-methylphenyl, p-chlorophenyl).

Examples of the heterocyclic group represented by R or $R_1$ include an unsubstituted heterocyclic group having from 1 to 20, preferably from 3 to 10, more preferably from 4 to 8, carbon atoms (e.g., 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridazyl, 2-pyrimidyl, 3-pyrazyl, 2-(1,3,5-triazolyl), 3-(1,2,4-triazolyl), 5-tetrazolyl), and a substituted heterocyclic group having from 1 to 20, preferably from 3 to 10, more preferably from 4 to 8, carbon atoms (e.g., the above-described heterocyclic group substituted by V, specifically, 5-methyl-2-thienyl, 4-methoxy-2-pyridyl).

R is preferably an alkyl group, more preferably a substituted or unsubstituted alkyl group having from 1 to 6 carbon atoms, still more preferably an unsubstituted alkyl group having from 1 to 4 carbon atoms.

$Z_1$ and $Z_2$ each is preferably oxygen atom or sulfur atom, and at least one of $Z_1$ and $Z_2$ is more preferably sulfur atom.

$R_1$ is preferably an alkyl group, more preferably an alkyl group having an acidic group (for example, a sulfo group, a carboxyl group, a sulfato group, a phosphono group, a borono group or a substituent described above for $R_2$), still more preferably an alkyl group having from 1 to 6 carbon atoms and having a sulfo group, particularly preferably a sulfoalkyl group having from 2 to 4 carbon atoms.

The methine group represented by $L_1$, $L_2$ or $L_3$ may be unsubstituted or substituted and when substituted, examples of the substituent are the same as those of the substituent V.

$n_1$ is 0, 1 or 2 and when $n_1$ is 2, two pairs of $L_2$ and $L_3$ may be the same or different. Also, two methine groups may be combined with each other to form a ring.

In a preferred embodiment of the compound, $n_1$ is 1, $L_1$ and $L_3$ each is an unsubstituted methine group, and $L_2$ is a methine group substituted by an alkyl group. The alkyl group on the methine group represented by $L_2$ is preferably a substituted or unsubstituted alkyl group having from 1 to 4 carbon atoms, more preferably methyl or ethyl.

$V_1$, $V_2$, $V_3$, $V_4$, $W_1$, $W_2$, $W_3$ and $W_4$ each represents hydrogen atom or a substituent and two of these substituents may be combined with each other to form a condensed ring.

The π value used in the present invention is described below. The π value is a parameter showing the effect of a substituent upon the hydrophilicity/hydrophobicity of a molecule of a compound and is defined by the following formula:

$$\pi = \log P(PhX) - \log P(PhH)$$

wherein P is a distribution coefficient of the compound to octanol/water and the difference between the logP value of substituted benzene PhX and the logP value of benzene is assigned to the π value of the substituent X. The logP value can be determined based on the actual measurement according to the method described in the following publication (a) or can be determined by the calculation using the fragment method described in the publication (a) or the software package described in the publication (b). In the case where the found value does not agree with the calculated value, the found π value is used in principle.

(a) C. Hansch and A. J. Leo, *Substituent Constants for Correlation Analysis in Chemistry and Biology,* John Wiley & Sons, New York (1979)

(b) Medichem software package (Ver. 3.54) developed by and available from Pomona College, Claremont, Calif.

Incidentally, for example, when $V_1$ and $V_2$ are combined with each other to form a naphthazole ring system, the π value assigned to $V_1$ and $V_2$ can be determined as follows by regarding the —CH═CH—CH═CH— as a substituent. The same applies to other condensed rings.

$$\pi(-(CH)_4-) = \log P(\text{naphthalene}) - \log P(\text{benzene}) = 1.32$$

The π values of respective substituents determined as above are listed in the publication (a). Main substituents are selected and their π values are shown below.

| Substituent | π value |
|---|---|
| OH | −0.67 |
| CN | −0.57 |
| $COCH_3$ | −0.55 |
| COOH | −0.32 |
| $OCH_3$ | −0.02 |
| $COOCH_3$ | −0.01 |
| H | 0.00 |
| F | 0.14 |
| $CH_3$ | 0.56 |
| Cl | 0.71 |
| Br | 0.86 |
| I | 1.12 |
| —$(CH)_4$— | 1.32 |
| $C_6H_5$ | 1.96 |

In the present invention, assuming that the total sum of the π values of the substituents $V_1$ to $V_4$ is $\pi_v$ and the total sum of the π values of the substituents $W_1$ to $W_4$ is $\pi_w$, either one of $\pi_v$ and $\pi_w$ must be 0.70 or less. The sum of $\pi_v$ and $\pi_w$ is preferably 1.40 or less. Furthermore, it is preferred that either one of $\pi_v$ and $\pi_w$ is 0.70 or more and the other is 0.70 or less, more preferably one is from 0.70 to 1.40 and the other is from 0.00 to 0.70, still more preferably $\pi_v$ is 0.70 or less and $\pi_w$ is 0.70 or more, and most preferably $\pi_v$ is from 0.00 to 0.70 and $\pi_w$ is from 0.70 to 1.40.

$R_a$, $R_b$, $R_c$ and $R_d$ in the group represented by $R_2$ each represents an alkyl group, an aryl group, a heterocyclic group, an alkoxy group, an aryloxy group, a heterocyclyloxy group or an amino group. Preferred examples thereof are described below.

Preferred examples thereof include an unsubstituted alkyl group having from 1 to 18, preferably from 1 to 10, more preferably from 1 to 5, carbon atoms (e.g., methyl, ethyl, propyl, butyl), a substituted alkyl group having from 1 to 18, preferably from 1 to 10, more preferably from 1 to 5, carbon atoms (e.g., hydroxymethyl, trifluoromethyl, benzyl, carboxyethyl, ethoxycarbonylmethyl, acetylaminomethyl; the substituted alkyl group as used herein also includes an unsaturated hydrocarbon group preferably having from 2 to 18, more preferably from 3 to 10, still more preferably from 3 to 5, carbon atoms (e.g., vinyl, ethynyl, 1-cyclohexenyl, benzylidine, benzylidene)), a substituted or unsubstituted aryl group having from 6 to 20, preferably from 6 to 15, more preferably from 6 to 10, carbon atoms (e.g., phenyl, 1-naphthyl, p-carboxyphenyl, p-nitrophenyl, 3,5-dichlorophenyl, p-cyanophenyl, m-fluorophenyl, p-tolyl), a heterocyclic group having from 1 to 20, preferably from 2 to 10, more preferably from 4 to 6, carbon atoms (e.g., pyridyl, 5-methylpyridyl, thienyl, furyl, morpholino, tetrahydrofurfuryl), an alkoxy group having from 1 to 10, preferably from 1 to 8, carbon atoms (e.g., methoxy, ethoxy, 2-methoxyethoxy, 2-hydroxyethoxy, 2-phenylethoxy), an aryloxy group having from 6 to 20, preferably from 6 to 12, more preferably from 6 to 10, carbon atoms (e.g., phenoxy, p-methylphenoxy, p-chlorophenoxy, naphthoxy), a heterocyclyloxy group having from 1 to 20, preferably from 3 to 12, more preferably from 3 to 10, carbon atoms (e.g., 2-thienyloxy, 2-morpholinooxy), and an amino group having from 0 to 20, preferably from 0 to 12, more preferably from 0 to 8, carbon group (e.g., amino, methylamino, dimethylamino, ethylamino, diethylamino, hydroxyethylamino, benzylamino, anilino, diphenylamino, morpholino formed into a ring, pyrrolidino). These groups each may be substituted by the substituent V.

Among these, more preferred are methyl, ethyl and hydroxyethyl, still more preferred is methyl.

The methylene group represented by $L_a$, $L_b$, $L_c$, $L_d$ or $L_e$ may be unsubstituted or substituted by a substituent and the substituent is not particularly limited but preferred examples thereof include the substituent V.

Specific examples of the substituted methylene group include a methyl-substituted methylene group, an ethyl-substituted methylene group, a phenyl-substituted methylene group, a hydroxy-substituted methylene group and a halogen (e.g., chlorine, bromine)-substituted methylene group. The methylene group is preferably an unsubstituted methylene group.

$k_a$, $k_b$, $k_c$, $k_d$ and $k_e$ each represents an integer of 1 or more, preferably from 1 to 4, more preferably 1 or 2, still more preferably 1. When $k_a$, $k_b$, $k_c$, $k_d$ and $k_e$ each is 2 or more, the repeated $L_a$, $L_b$, $L_c$, $L_d$ or $L_e$ may not be the same.

The dissociative groups NH and OH of $R_2$ are denoted by the non-dissociative form in all cases but these can take a dissociated form ($N^-$ or $O^-$) . Actually, these groups assume the dissociated state or the non-dissociated state depending on the environment where the dye is present, such as pH.

With respect to the notation, the group in the dissociated state is denoted, for example, as $N^-$. In the case where a cationic compound (for example, sodium ion) is present as a counter salt, the notation is $N^-Na^+$. Even in the non-dissociated state, if the cationic compound as a counter salt is regarded as a proton, the notation of $N^-H^+$ may be used.

Preferred examples of $R_2$ are shown below. In all cases, the dissociative group is denoted by the non-dissociated form.

$R_{2a}$=—$CH_2CONHSO_2CH_3$ $R_{2b}$=—$CH_2COOH$ $R_{2c}$=—$CH_2SO_2NHCOCH_3$ $R_{2d}$=—$CH_2CONHCOCH_3$ $R_{2e}$=—$CH_2SO_2NHSO_2CH_3$ $R_{2f}$=—$(CH_2)_2CONHSO_2CH_3$ $R_{2g}$=—$(CH_2)_2COOH$ $R_{2h}$=—$(CH_2)_2SO_2NHCOCH_3$ $R_{2i}$=—$(CH_2)_2CONHCOCH_3$ $R_{2j}$=—$(CH_2)_2SO_2NHSO_2CH_3$

In the above, the groups positioned earlier are more preferred. Among these, particularly preferred are $R_{2a}$ and $R_{2b}$ .

M is contained in the formula so as to show the presence of cation or anion when such ion is necessary for neutralizing the ion charge. Whether a dye is cation or anion or whether or not a dye has a net ion, depends on the substituent. Typical examples of the cation include inorganic cation such as hydrogen ion, alkali metal ion (e.g., sodium ion, potassium ion, lithium ion), alkaline earth metal ion (e.g., calcium ion) and an organic anion such as ammonium ion (e.g., ammonium ion, tetraalkylammonium ion, pyridinium ion, ethylpyridinium ion). The anion may be either inorganic anion or organic anion and examples thereof include halide anion (e.g., fluoride anion, chloride anion, bromide ion, iodide ion), substituted arylsulfonate ion (e.g., p-toluenesulfonate ion, p-chlorobenzenesulfonate ion), aryldisulfonate ion (e.g., 1,3-benzenedisulfonate ion, 2,6-naphthalenedisulfonate ion), alkylsulfate ion (e.g., methylsulfate ion), sulfate ion, thiocyanate ion, perchlorate ion, tetrafluoroborate ion, picrate ion, acetate ion and trifluoromethanesulfonate ion.

Among those cations, preferred are sodium ion, potassium ion, triethylammonium ion, tetraethylammonium ion, pyridinium, ethylpyridinium ion and methylpyridinium ion. Among those anions, preferred are perchlorate ion, iodide ion, bromide ion and substituted arylsulfonate ion (e.g., p-toluenesulfonate ion).

m represents a number of 0 or more necessary for balancing the electric charge in the molecule and when an inner salt is formed, m is 0. m is preferably a number of from 0 to 4.

The compound represented by formula (I) is more preferably a compound represented by formula (II) or (III).

The compound represented by formula (II) is described in detail below.

$Z_3$ and $Z_4$ each represents oxygen atom or sulfur atom. Preferably, at least one of $Z_3$ and $Z_4$ is sulfur atom and more preferably, both are sulfur atom.

$A_1$ represents hydrogen atom or an alkyl group and preferred examples of the alkyl group include the unsubstituted or substituted alkyl groups described above for R. The alkyl group is more preferably a substituted or unsubstituted alkyl group having from 1 to 4 carbon atoms, still more preferably methyl or ethyl.

Either one of $V_5$ and $W_5$ is a substituent selected from the group consisting of hydrogen atom, fluorine atom, a methyl group, a methylthio group, an ethoxy group, an ethoxycarbonyl group, a 2-pyridyl group and a 4-pyridyl group, preferably hydrogen atom or fluorine atom. The other is a substituent selected from the group consisting of chlorine atom, bromine atom, iodine atom, a trifluoromethyl group, an ethyl group, a benzoyl group and a 1-pyrrolyl group, preferably chlorine atom or bromine atom.

The alkyl group having a sulfo group as a substituent, represented by $R_3$, may have a substituent other than the sulfo group. For example, oxygen or other non-carbon atomic group may be interposed between the sulfo group and the alkyl group as in a sulfopropyloxyethyl group. The alkyl group is preferably an alkyl group directly substituted by a sulfo group, more preferably a 3-sulfopropyl group, a 3-sulfobutyl group or a 4-sulfobutyl group.

Preferred examples of the methylene group represented by $L_f$ are the same as those described above for $L_a$. The methylene group is more preferably an unsubstituted methylene group.

$k_f$ is an integer of from 1 to 3, preferably 1 or 2, more preferably 1.

The compound represented by formula (III) is described in detail below.

$Z_5$ and $Z_6$ each represents oxygen atom or sulfur atom. Preferably, at least one $Z_5$ and $Z_6$ is sulfur atom, and more preferably, both are sulfur atom.

$A_2$ represents hydrogen atom or an alkyl group and preferred examples of the alkyl group include those described above as preferred examples of the unsubstituted or substituted alkyl group represented by R. The alkyl group is more preferably a substituted or unsubstituted alkyl group having from 1 to 4 carbon atoms, still more preferably methyl or ethyl.

$V_6$ is a substituent selected from the group consisting of hydrogen atom, fluorine atom, a mercapto group, a methyl group, a methylthio group, an ethoxy group, an ethoxycarbonyl group, a 2-pyridyl group and a 4-pyridyl group, preferably hydrogen atom or fluorine atom, more preferably fluorine atom.

$W_6$ is a substituent selected from the group consisting of chlorine atom, bromine atom, iodine atom, a trifluoromethyl group, an ethyl group, a benzoyl group and a 1-pyrrolyl group, preferably chlorine atom or bromine atom, more preferably chlorine atom.

$R_4$ represents an alkyl group having a sulfo group as a substituent and preferred examples thereof are the same as those described above for $R_3$. The alkyl group is more preferably an alkyl group directly substituted by a sulfo group, still more preferably a 3-sulfopropyl group, a 3-sulfobutyl group or a 4-sulfobutyl group.

Preferred examples of the alkyl group represented by $R_g$ are the same as those described above for $R_a$ and the alkyl group is more preferably methyl or ethyl, still more preferably methyl.

Preferred examples of the methylene group represented by $L_g$ are the same as those described above for $L_a$ and the methylene group is more preferably an unsubstituted methylene group.

$k_g$ is an integer of from 1 to 3, preferably 1 or 2, more preferably 1.

Specific examples of the compounds represented by formulae (I), (II) and (III) of the present invention are shown below, however, the present invention is by no means limited thereto.

I-1
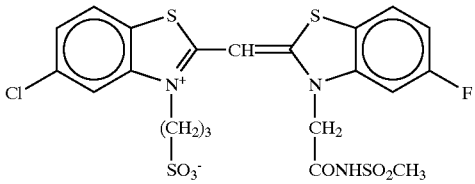
I-2
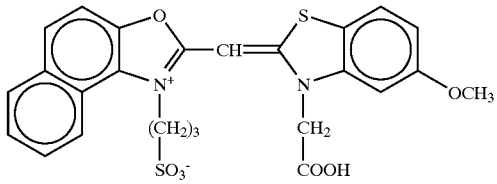
I-3
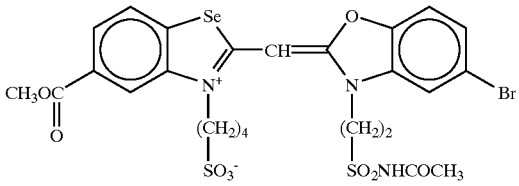
I-4
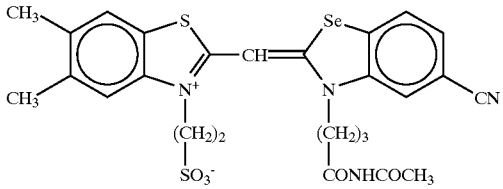
I-5
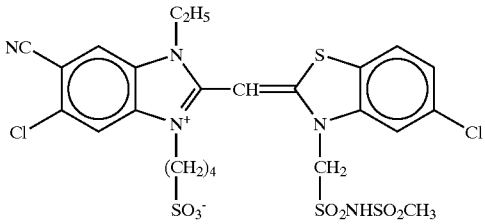
I-6
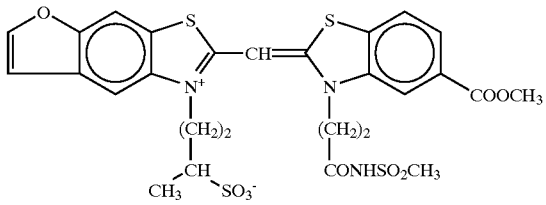
I-7
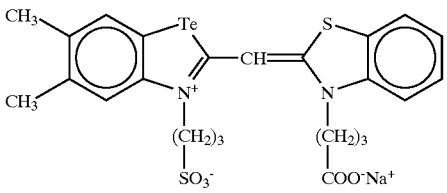
I-8
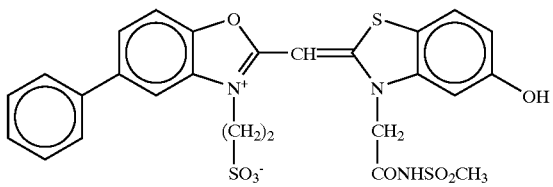
I-9
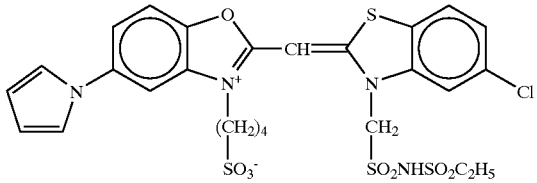
I-10
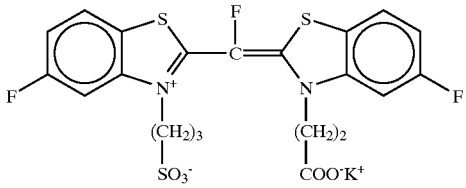
I-11
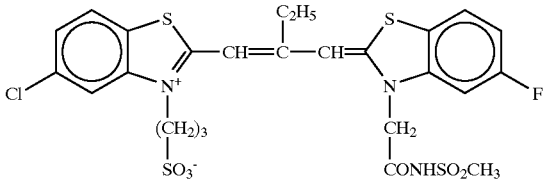
I-12
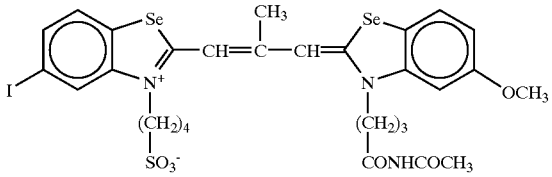
I-13
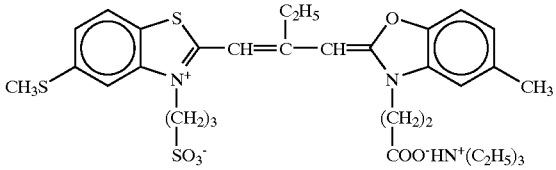
I-14
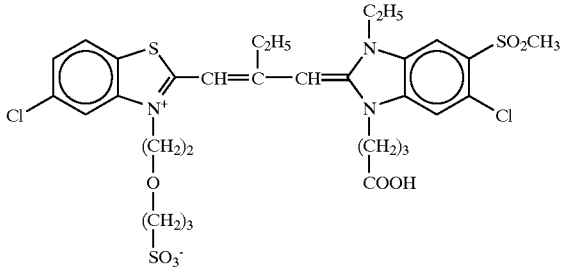

-continued
I-15
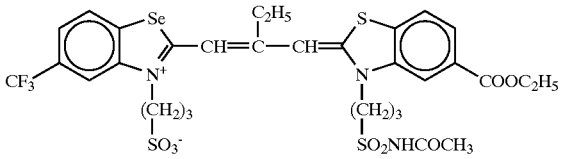
I-16
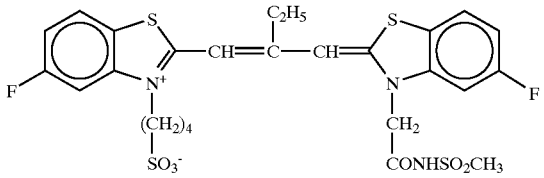
I-17
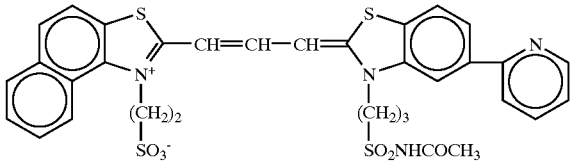
I-18
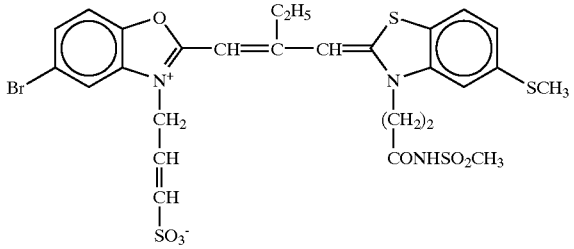
I-19
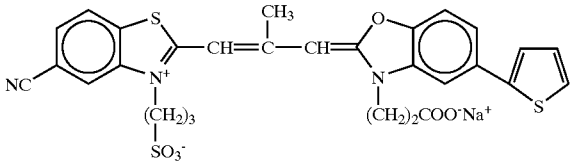
1-20
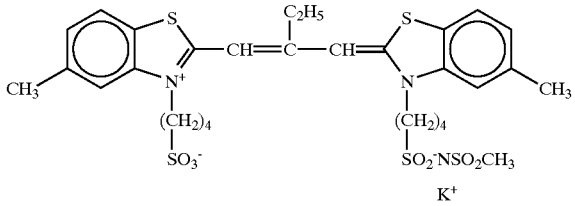
I-21
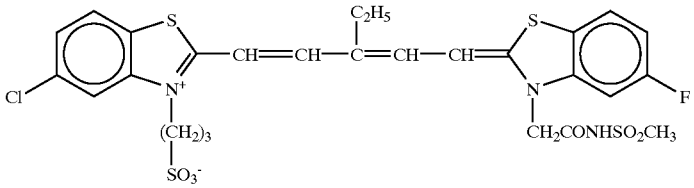
I-22
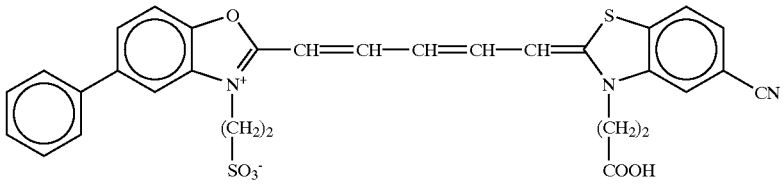
I-23
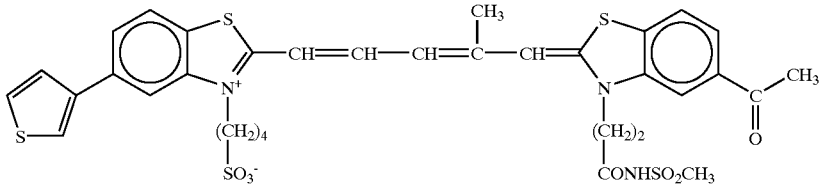
I-24
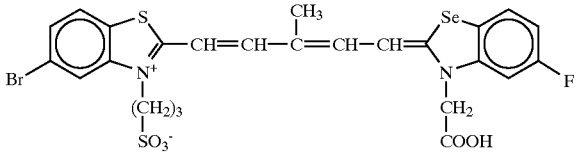
I-25
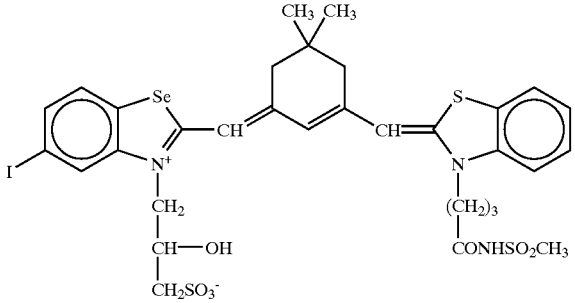

-continued

I-26

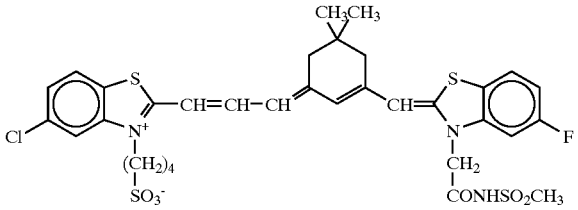

II-1

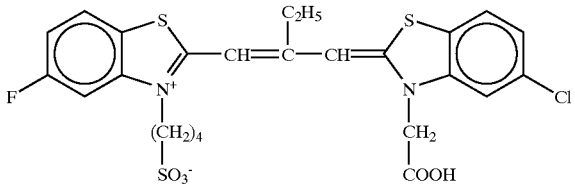

II-2

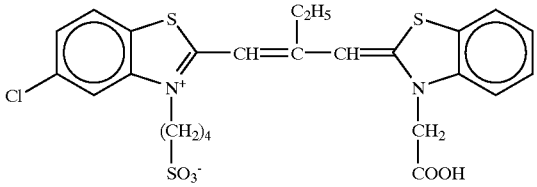

II-3

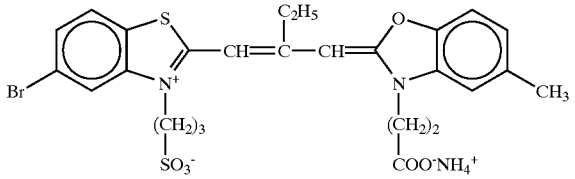

II-4

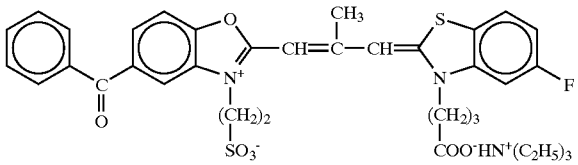

II-5

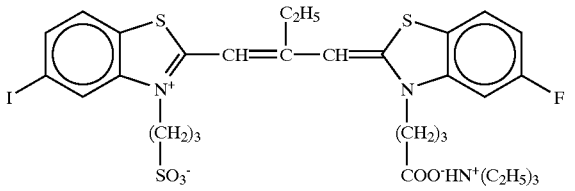

III-1

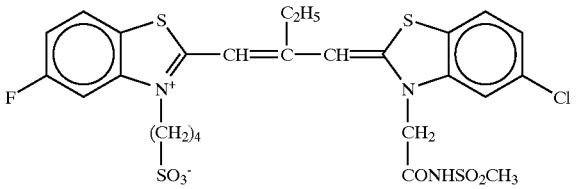

III-2

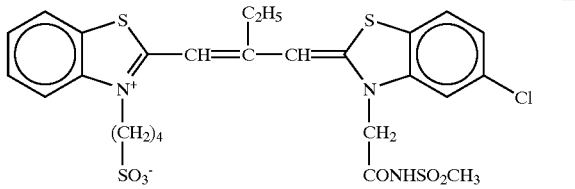

III-3

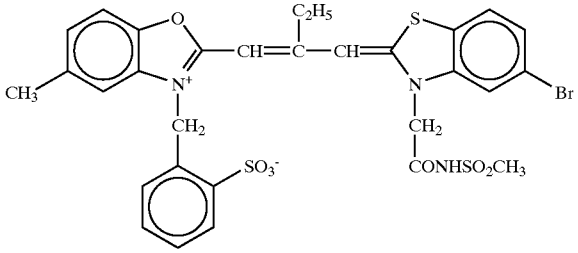

III-4

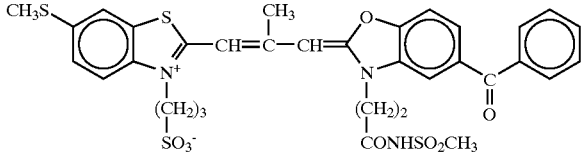

III-5

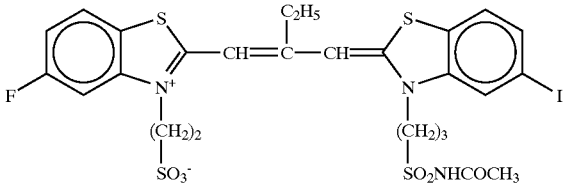

The compounds represented by formulae (I), (II) and (III) of the present invention can be synthesized according to the methods described in the following publications:

a) F. M. *Harmer, Heterocyclic Compounds-Cyanine dyes and related compounds,* John Wiley & Sons, New York, London (1964);

b) D. M. Sturmer, *Heterocyclic Compounds-Special topics in heterocyclic chemistry,* Chap. 8, Sec. 4, pp. 482–515, John Wiley & Sons, New York, London (1977); and c) *Rodd's Chemistry of Carbon Compounds,* 2nd ver. Vol. 4, part B, Chap. 15, pp. 369–422, Elsevier Science Publishing Company Inc., New York (1977).

Synthesis Example 1

(Synthesis of Compound II-1)

To 50 ml of methanol, 4.81 g of 4-{2-(2-ethoxy-1-butenyl)-5-chloro-3-benzothiazolio}butanesulfonate and 2.88 g of 3-carboxymethyl-2-methylbenzothiazolium bromide were added. The resulting solution was stirred at room temperature and thereto 8.5 ml of triethylamine was added dropwise, whereupon the solution immediately turned into a violet solution. This solution was stirred at room temperature for 3 hours, then filtered and after adding thereto 20 ml of acetic acid and further adding 250 ml of ethyl acetate, stirred under ice cooling, as a result, crystals precipitated. The crystals were filtered and then washed with methanol and subsequently with acetone to obtain 4.30 g of crude crystals of Compound II-1. The crude crystals were dissolved in 80 ml of methanol and 3 ml of triethylamine and after adding thereto 5 ml of acetic acid, heated and then concentrated by distilling off the solvent. As a result, crystals precipitated. Thereafter, this solution was cooled with ice and the crystals were filtered, washed and dried to obtain 3.85 g of Compound II-1 (yield: 68%).

λmax (MeOH)=548.7 nm

Synthesis Example 2

(Synthesis of Compound III-1)

To 50 ml of methanol, 4.65 g of 4-{2-(2-ethoxy-1-butenyl)-5-fluoro-3-benzothiazolio}butanesulfonate and 4.00 g of 5-chloro-3-methanesulfonylcarbamoylmethyl-2-methylenzothiazolium bromide were added. The resulting solution was stirred at room temperature and thereto 8.5 ml of triethylamine was added dropwise, whereupon the solution immediately turned into a violet solution This solution was stirred at room temperature for 3 hours, then filtered and after adding thereto 17 ml of acetic acid, stirred under ice cooling, as a result, crystals precipitated. The crystals were filtered and then washed with methanol and subsequently with acetone to obtain 4.50 g of crude crystals of Compound III-1. The crude crystals were dissolved in 80 ml of methanol and 3 ml of triethylamine and after adding thereto 5 ml of acetic acid, heated and then concentrated by distilling off the solvent. As a result, crystals precipitated. Thereafter, this solution was cooled with ice and the crystals were filtered, washed and dried to obtain 3-99 g of Compound III-1 (yield: 60%).

λmax (MeOH)=551.4 nm

The compound represented by formula (I), (II) or (III) of the present invention may be incorporated into the silver halide emulsion of the present invention by directly dissolving the compound in the emulsion or may be added to the emulsion after dissolving the compound in a solvent such as water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol or N,N-dimethylformamide, or a mixed solvent thereof.

Other than these, the compound may be incorporated by the method of dissolving a dye in a volatile organic solvent, dispersing the solution in water or hydrophilic colloid, and adding the dispersion into an emulsion described in U.S. Pat. No. 3,469,987, the method of dispersing a water-insoluble dye in a water-soluble solvent without dissolving it, and adding the dispersion to an emulsion described in JP-B-46-24185 (the term "JP-B" as used herein means an "examined Japanese patent publication"), the method of dissolving a dye in an acid and adding the resulting solution to an emulsion, or forming an aqueous solution while allowing an acid or base to be present together and then adding the aqueous solution to an emulsion described in JP-B-44-23389, JP-B-44-27555 and JP-B-57-22091, the method of forming an aqueous solution or colloid dispersion while allowing a surfactant to be present together and adding it to an emulsion described in U.S. Pat. Nos. 3,822,135 and 4,006,026, the method of dispersing a dye directly in a hydrophilic colloid and adding the resulting dispersion to an emulsion described in JP-A-53-102733 (the term "JP-A" as used herein means an "unexamined published Japanese patent application") and JP-A-58-105141, or the method of dissolving a dye using a compound capable of red shifting, and adding the resulting solution to an emulsion described in JP-A-51-74624. For the dissolution, an ultrasonic wave may also be used.

The compound represented by formula (I), (II) or (III) of the present invention may be added to the silver halide emulsion of the present invention in any step during the preparation of the emulsion, which is heretofore recognized as useful. The addition may be performed at any time or step as long as it is before the coating of the emulsion, for example, during the formation of silver halide grains and/or before the desalting, during the desalting and/or after the desalting but before the initiation of chemical ripening as disclosed in U.S. Pat. Nos. 2,735,766, 3,628,960, 4,183,756 and 4,225,666, JP-A-58-184142 and JP-A-60-196749, immediately before or during the chemical ripening, or after the chemical ripening but before the coating as disclosed in JP-A-58-113920. Also, as disclosed in U.S. Pat. 4,225,666 and JP-A-58-7629, the same compound solely or in combination with a compound having a different structure may be added in parts, for example, during the grain formation and during or after the completion of chemical ripening, or before- or during the chemical ripening and after the completion of chemical ripening. When added in parts, the -kind of the compound or the combination of compounds may be varied.

The added amount of the compound represented by formula (I), (II) or (III) of the present invention varies depending on the shape and size of silver halide grain, however, it is usually from $1\times10^{6}$ to $1\times10^{-2}$ mol, preferably from $2\times10^{-6}$ to $8\times10^{-3}$ mol, more preferably from $6\times10^{-6}$ to $6\times10^{-3}$, per mol of silver halide. The compound of the present invention may be used alone but is preferably used in combination with other spectral sensitizing dye.

The silver halide photographic light-sensitive material of the present invention is descried in detail below.

The silver halide which can be used in the silver halide photographic light-sensitive martial of the present invention may be any of silver bromide, silver iodobromide, silver iodochlorobromide, silver chlorobromide and silver chloride. Among these, preferred are silver bromide, silver iodobromide, silver chlorobromide iodochlorobromide and silver halide having high silver chloride content described in JP-A-2-42, more preferred are silver bromide and silver iodobromide.

The silver halide grain contained in the photographic emulsion may be a grain having a regular crystal form such as cubic, octahedral or tetradecahedral form, a grain having an irregular crystal form such as spherical or tabular form, or a mixture thereof. In the present invention, the emulsion suitably contains grains having the above-described regular crystal form in a proportion of 50% or more, preferably 70% or more, more preferably 90% or more.

The emulsion preferably comprises tabular grains having an aspect ratio of 3 or more, more preferably from 8 to 100.

The emulsion for use in the present invention can be prepared by the method described, for example, in P. Glafkides, *Chemie et Phisique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964). More specifically, any of an acidic process, a neutral process and an ammonia process may be used, and the reaction form between a soluble silver salt and a soluble halogen salt may be any of a single jet method, a double jet method and a combination thereof. Also, the grain can be formed in an atmosphere of excess silver ion (so-called reverse mixing method) . As one mode of the double jet method, a so-called controlled double jet method where the pAg of a liquid phase in which the silver halide is formed is kept constant, may also be used. According to this method, the silver halide emulsion obtained can have a regular crystal form and a nearly uniform grain size.

The silver halide emulsion for use in the present invention is usually subjected to chemical sensitization and spectral sensitization. For the chemical sensitization, chemical sensitization using a chalcogen sensitizer (to speak specifically, sulfur sensitization represented by the addition of a labile sulfur compound, selenium sensitization by a selenium compound, and tellurium sensitization by a tellurium compound) , noble metal sensitization represented by gold sensitization, and reduction sensitization may be used individually or in combination. Preferred examples of the compound for use in the chemical sensitization include those described in JP-A-62-215272, from page 18, right lower column to page 22, right upper column.

The silver halide emulsion for use in the present invention may contain various compounds or precursors thereof, for the purpose of preventing the fogging during the production, storage or photographic processing of a light-sensitive material or stabilizing the photographic capabilities. Specific preferred examples of such compounds include those described in JP-A-62-215272, pp. 39–72. Also, 5-arylamino-1,2,3,4-thiatriazole compounds (the aryl residue has at least one -electron withdrawing group) described in EP-A-447647 may be preferably used.

With respect to various techniques and inorganic/organic materials which can be used in the silver halide photographic light-sensitive material of the present invention, those described in *Research Disclosure,* Nos. 308119 (1989) and 37038 (1995) may be generally used.

In addition, to speak more specifically, the technique and inorganic/organic material which can be used in color photographic light-sensitive materials to which the silver halide photographic emulsion of the present invention can be applied, are described in the following portions of EP-A-436938 and cited patents therein.

| | Items | Pertinent Portions |
|---|---|---|
| 1) | Layer Structure | from page 146, line 34 to page 147, line 25 |
| 2) | Silver halide emulsion | from page 147, line 26 to page 148, line 12 |
| 3) | Yellow coupler | from page 137, line 35 to page 146, line 33, page 149, lines 21 to 23 |
| 4) | Magenta coupler | page 149, lines 24 to 28; EP-A-421453, from page 3, line 5 to page 25, line 55 |
| 5) | Cyan coupler | from page 149, lines 29 to 33; EP-A-432804, from page 3, line 28 to page 40, line 2 |
| 6) | Polymer coupler | page 149, lines 34 to 38, EP-A-435334, from page 113, line 39 to page 123, line 37 |
| 7) | Colored coupler | from page 53, line 42 to page 137, line 34; page 149, lines 39 to 45 |
| 8) | Other functional couplers | from page 7, line 1 to page 53, line 41; from page 149, line 46 to page 150, line 3; EP-A-435334, from page 3, line 1 to page 29, line 50 |
| 9) | Antiseptic | page 150, lines 25 to 28 |

-continued

| | Items | Pertinent Portions |
|---|---|---|
| 10) | Formalin scavenger | page 149, lines 15 to 17 |
| 11) | Other additives | page 153, lines 38 to 47; EP-A-421453, from page 75, line 21 to page 84, line 56 |
| 12) | Dispersion method | page 150, lines 4 to 24 |
| 13) | Support | page 150, lines 32 to 34 |
| 14) | Film thickness, physical properties | page 150, lines 35 to 49 |
| 15) | Color development | from page 150, line 50 to page 151, line 47 |
| 16) | Desilvering | from page 151, line 48 to page 152, line 53 |
| 17) | Automatic developing machine | from page 152, line 54 to page 153, line 2 |
| 18) | Water washing/ stabilization | page 153, lines 3 to 37 |

The silver halide emulsion prepared according to the present invention can be used for both color photographic light-sensitive material and black-and-white light-sensitive material. Examples of the color photographic light-sensitive material include color paper, color photographing film and color reversal film, and examples of the black-and-white photographic light-sensitive material include X-ray film, general photographing film and printing light-sensitive material film. Among these, preferred is color reversal film.

The present invention can be preferably applied to silver halide color photographic light-sensitive materials having a transparent magnetic recording layer. The silver halide light-sensitive material having a magnetic recording may be prepared in such a manner that a previously heat-treated polyester thin layer support described in detail in JP-A-6-35118, JP-A-6-17528 and *JIII Journal of Technical Disclosure* No. 94-6023 (for example, a polyethylene aromatic dicarboxylate-base polyester support), having a thickness of from 50 to 300 $\mu$m, preferably from 50 to 200 $\mu$m, more preferably from 80 to 115 $\mu$m, is heat treated (annealed) at a temperature of from 40° C. to a glass transition temperature for 1 to 1,500 hours, the support is then subjected to a surface treatment such as ultraviolet irradiation described in JP-B-43-2603, JP-B-43-2604 and JP-B-45-3828, corona discharge described in JP-B-48-5043 and JP-A-51-131576, and glow discharge described in JP-B-35-7578 and JP-B-46-43480, undercoating described in U.S. Pat. 5,326,689 is applied thereon, a subbing layer described in U.S. Pat. No. 2,761,791 is provided, if desired, and ferromagnetic particles described in JP-A-59-23505, JP-A-4-195726 and JP-A-6-59357 are coated thereon.

The magnetic layer may be coated like stripes as described in JP-A-4-124642 and JP-A-4-124645.

The support may further be subjected to an antistatic treatment described in JP-A-4-62543, if desired, and finally, a silver halide photographic emulsion is coated thereon. For the silver halide grain used here, those described in JP-A-4-166932, JP-A-3-41436 and JP-A-3-41437 may be used.

This silver halide photographic light-sensitive material is preferably manufactured according to a manufacture control method described in JP-B-4-86817 and the manufacturing data are preferably recorded thereon by the method described in JP-B-6-87146. After or before the recording, the light-sensitive material is cut into a film smaller in the width than conventional 135 size films, and two perforations are punched in one side per one small-format picture according to the method described in JP-A-4-125560 so as to match the format picture smaller than conventional films.

The thus-prepared film is loaded in a cartridge package described in JP-A-4-157459, a cartridge described in JP-A-5-210202, FIG. 9, a film patrone described in U.S. Pat. No. 4,221,479 or a cartridge described in U.S. Pat. Nos. 4,834,306, 4,834,366, 5,226,613 and 4,846,418, and then used.

The film cartridge or film patrone used here is preferably of such a type that the tongue can be housed as described in U.S. Pat. Nos. 4,848,693 and 5,317,355 in view of the light-shielding property.

Also, a cartridge having a lock mechanism described in U.S. Pat. No. 5,296,886, a cartridge capable of indicating the use state described in U.S. Pat. No. 5,347,334 or a cartridge having a function of preventing double exposure is preferably used.

Furthermore, a cartridge where the film can be easily loaded by merely inserting the film into the cartridge described in JP-A-6-85128 may also be used.

The thus-produced film cartridge may be used for various photographic enjoyments by performing the photographing and development processing to satisfy the object using a camera, a developing machine or a laboratory machine.

The film cartridge (patrone) can fully exert its function when, for example, a camera in a simple loading system described in JP-A-6-8886 and JP-A-6-99908, a camera having an automatic winding-up system described in JP-A-6-57398 and JP-A-6-101135, a camera where the film can be taken out and exchanged on the way of photographing described in JP-A-6-205690, a camera where the photographing information such as panorama photographing, high-vision photographing or normal photographing (capable of magnetic recording such that the print aspect ratio can be selected) can be magnetic recorded on the film described in JP-A-5-293138 and JP-A-5-283382, a camera having a function of preventing double exposure described in JP-A-6-101194 or a camera having a function to indicate the use state of the film or the like described JP-A-5-150577, is used.

The thus-photographed film may be processed in an automatic developing machine described in JP-A-6-222514 and JP-A-6-212545 and before, during or after the processing, the use method of magnetic recording on a film described in JP-A-6-95265 and JP-A-4-123054 may be used. Also, the print aspect ratio selecting function described in JP-A-5-19364 may be used.

At the time of development processing of the film, in the case of cine-type development, the film is spliced according to the method described in JP-A-5-119461 before the processing.

During or after the development processing, the film may be subjected to an attaching/detaching operation described in JP-A-6-148805.

After such processing, the film information may be converted into a print through back printing or front printing on a color paper according to the method described in JP-A-2-184835, JP-A-4-186335 and JP-A-6-79968.

Furthermore, the film may be returned to the user together with the index print and the cartridge for return described in JP-A-5-11353 and JP-A-5-232594.

The present invention is described below in greater detail by referring to the Examples, but the present invention should not be construed as being limited thereto.

EXAMPLE 1

(Preparation of Sample 101)

A multi-layer color light-sensitive material comprising a 127 μm-thick undercoated cellulose triacetate film support having thereon layers each having the following composition was manufactured and designated as Sample 101. The numerals each indicates the added amount per $m^2$. The effect of each compound added is not limited to the use described below.

First Layer: Antihalation Layer

| | |
|---|---|
| Black colloidal silver | 0.10 g |
| Gelatin | 2.00 g |
| Ultraviolet Absorbent U-1 | 0.20 g |
| Ultraviolet Absorbent U-3 | 0.040 g |
| Ultraviolet Absorbent U-4 | 0.15 g |
| High Boiling Point Organic Solvent Oil-1 | 0.10 g |
| Dye D-4 | 1.0 mg |
| Dye D-8 | 2.5 mg |
| Fine crystal solid dispersion of Dye E-1 | 0.10 g |

Second Layer: Interlayer

| | |
|---|---|
| Gelatin | 0.40 g |
| Compound Cpd-C | 0.5 mg |
| Compound Cpd-J | 1.5 mg |
| Compound Cpd-K | 4.0 mg |
| High Boiling Point Organic Solvent Oil-3 | 0.010 g |
| High Boiling Point Organic Solvent Oil-4 | 0.020 g |
| High Boiling Point Organic Solvent Oil-5 | 2.0 mg |
| High Boiling Point Organic Solvent Oil-7 | 2.0 mg |
| High Boiling Point Organic Solvent Oil-8 | 5.0 mg |
| Dye D-7 | 2.5 mg |

Third Layer: Interlayer

| | | |
|---|---|---|
| Yellow colloidal silver | as silver | 0.010 g |
| Gelatin | | 0.40 g |
| Compound Cpd-M | | 0.015 g |
| High Boiling Point organic Solvent Oil-3 | | 0.020 g |

Fourth Layer: First Red-sensitive Emulsion Layer

| | | |
|---|---|---|
| Emulsion A | as silver | 0.20 g |
| Emulsion B | as silver | 0.20 g |
| Emulsion C | as silver | 0.15 g |
| Gelatin | | 0.70 g |
| Coupler C-1 | | 0.10 g |
| Coupler C-2 | | 0.050 g |
| Coupler C-3 | | 0.050 g |
| Coupler C-9 | | 0.010 g |
| Coupler C-11 | | 0.050 g |
| Compound Cpd-C | | 5.0 mg |
| Compound Cpd-I | | 0.020 g |
| Compound Cpd-J | | 5.0 mg |
| High Boiling Point Organic Solvent Oil-2 | | 0.10 g |
| Additive P-1 | | 0.10 g |

Fifth Layer: Second Red-sensitive Emulsion Layer

| | | |
|---|---|---|
| Emulsion C | as silver | 0.25 g |
| Emulsion D | as silver | 0.25 g |
| Gelatin | | 0.70 g |
| Coupler C-1 | | 0.15 g |
| Coupler C-2 | | 0.050 g |

-continued

| | | |
|---|---|---|
| Coupler C-3 | | 0.020 g |
| Coupler C-11 | | 0.070 g |
| High Boiling Point Organic Solvent Oil-2 | | 0.10 g |
| Additive P-1 | | 0.10 g |

Sixth Layer: Third Red-sensitive Emulsion Layer

| | | |
|---|---|---|
| Emulsion E | as silver | 0.20 g |
| Emulsion F | as silver | 0.25 g |
| Gelatin | | 1.20 g |
| Coupler C-1 | | 0.10 g |
| Coupler C-2 | | 0.050 g |
| Coupler C-3 | | 0.20 g |
| Coupler C-11 | | 0.30 g |
| High Boiling Point Organic Solvent Oil-2 | | 0.10 g |
| High Boiling Point Organic Solvent Oil-9 | | 0.20 g |
| Compound Cpd-K | | 2.0 mg |
| Compound Cpd-F | | 0.050 g |
| Additive P-1 | | 0.10 g |

Seventh Layer: Interlayer

| | | |
|---|---|---|
| Gelatin | | 0.60 g |
| Additive M-1 | | 0.30 g |
| Compound Cpd-I | | 2.6 mg |
| Dye D-5 | | 0.020 g |
| Dye D-6 | | 0.010 g |
| Compound Cpd-M | | 0.040 g |
| Compound Cpd-O | | 3.0 mg |
| Compound Cpd-P | | 2.5 mg |
| High Boiling Point Organic Solvent Oil-1 | | 0.020 g |
| High Boiling Point Organic Solvent Oil-6 | | 0.050 g |

Eighth Layer: Interlayer

| | | |
|---|---|---|
| Yellow colloidal silver | as silver | 0.010 g |
| Gelatin | | 0.60 g |
| Additive P-1 | | 0.05 g |
| Compound Cpd-A | | 0.10 g |
| Compound Cpd-M | | 0.10 g |
| High Boiling Point Organic Solvent Oil-6 | | 0.10 g |

Ninth Layer: First Green-sensitive Layer

| | | |
|---|---|---|
| Emulsion G | as silver | 0.25 g |
| Emulsion H | as silver | 0.30 g |
| Emulsion I | as silver | 0.25 g |
| Gelatin | | 1.00 g |
| Coupler C-7 | | 0.10 g |
| Coupler C-8 | | 0.17 g |
| Compound Cpd-B | | 0.300 g |
| Compound Cpd-D | | 0.020 g |
| Compound Cpd-E | | 0.020 g |
| Compound Cpd-G | | 2.5 mg |
| Compound Cpd-F | | 0.040 mg |
| Compound Cpd-K | | 2.0 mg |
| Compound Cpd-L | | 0.020 g |
| High Boiling Point Organic Solvent Oil-1 | | 0.05 g |
| High Boiling Point Organic Solvent Oil-2 | | 0.10 g |

Tenth Layer: Second Green-sensitive Layer

| | | |
|---|---|---|
| Emulsion I | as silver | 0.20 g |
| Emulsion J | as silver | 0.20 g |
| Gelatin | | 0.70 g |
| Coupler C-4 | | 0.25 g |
| Compound Cpd-B | | 0.030 g |
| Compound Cpd-D | | 0.020 g |
| Compound Cpd-F | | 0.050 g |
| Compound Cpd-G | | 2.0 mg |
| High Boiling Point Organic Solvent Oil-2 | | 0.10 g |

Eleventh Layer: Third Green-sensitive Layer

| | | |
|---|---|---|
| Emulsion K | as silver | 0.55 g |
| Gelatin | | 0.80 g |
| Coupler C-4 | | 0.35 g |
| Compound Cpd-B | | 0.080 g |
| Compound Cpd-D | | 0.020 g |
| Compound Cpd-F | | 0.040 g |
| Compound Cpd-K | | 5.0 mg |
| High Boiling Point Organic Solvent Oil-2 | | 0.15 g |

Twelfth Layer: Interlayer

| | | |
|---|---|---|
| Gelatin | | 0.30 g |
| Compound Cpd-M | | 0.05 g |
| High Boiling Point Organic Solvent Oil-3 | | 0.025 g |
| High Boiling Point Organic Solvent Oil-6 | | 0.025 g |

Thirteenth Layer: Yellow Filter Layer

| | | |
|---|---|---|
| Yellow colloidal silver | as silver | 5.0 mg |
| Gelatin | | 1.00 g |
| Compound Cpd-C | | 0.010 g |
| Compound Cpd-M | | 0.030 g |
| Compound Cpd-L | | 0.010 g |
| High Boiling Point Organic Solvent Oil-1 | | 0.020 g |
| Fine crystal solid dispersion of Dye E-2 | | 0.030 g |
| Fine crystal solid dispersion of Dye E-3 | | 0.020 g |

Fourteenth Layer: Interlayer

| | |
|---|---|
| Gelatin | 0.40 g |

Fifteenth Layer: First Blue-sensitive Layer

| | | |
|---|---|---|
| Emulsion L | as silver | 0.20 g |
| Emulsion M | as silver | 0.20 g |
| Gelatin | | 0.80 g |
| Coupler C-5 | | 0.20 g |
| Coupler C-6 | | 0.10 g |
| Coupler C-10 | | 0.10 g |
| Compound Cpd-I | | 0.010 g |
| Compound Cpd-M | | 0.010 g |

Sixteenth Layer: Second Blue-sensitive Layer

| | | |
|---|---|---|
| Emulsion N | as silver | 0.20 g |
| Emulsion O | as silver | 0.20 g |
| Gelatin | | 0.90 g |
| Coupler C-5 | | 0.10 g |
| Coupler C-6 | | 0.10 g |
| Coupler C-10 | | 0.10 g |
| Compound Cpd-N | | 2.0 mg |
| Compound Cpd-K | | 2.0 mg |
| High Boiling Point Organic Solvent Oil-2 | | 0.050 g |

Seventeenth Layer: Third Blue-sensitive Layer

| | | |
|---|---|---|
| Emulsion O | as silver | 0.20 g |
| Emulsion P | as silver | 0.25 g |
| Gelatin | | 1.20 g |
| Coupler C-5 | | 0.10 g |
| Coupler C-6 | | 0.10 g |
| Coupler C-10 | | 0.80 g |
| High Boiling Point Organic Solvent Oil-2 | | 0.10 g |
| Compound Cpd-N | | 5.0 mg |
| Compound Cpd-Q | | 0.20 g |

Eighteenth Layer: First Protective Layer

| | |
|---|---|
| Gelatin | 0.70 g |
| Ultraviolet Absorbent U-1 | 0.20 g |
| Ultraviolet Absorbent U-2 | 0.050 g |
| Ultraviolet Absorbent U-5 | 0.30 g |
| Compound Cpd-O | 5.0 mg |
| Compound Cpd-A | 0.030 g |
| Compound Cpd-H | 0.20 g |
| Dye D-1 | 0.10 g |
| Dye D-2 | 0.050 g |
| Dye D-3 | 0.07 g |

-continued

| | |
|---|---|
| High Boiling Point Organic Solvent Oil-3 | 0.10 g |

Nineteenth Layer: Second Protective Layer

| | | |
|---|---|---|
| Colloidal silver | as silver | 0.10 mg |
| Fine grain silver iodobromide emulsion (average grain size: 0.06 μm, AgI content: 1 mol %) | as silver | 0.10 g |
| Gelatin | | 0.50 g |

Twelfth Layer: Third Protective Layer

| | |
|---|---|
| Gelatin | 0.80 g |
| Polymethyl methacrylate (average particle size 1.5 μm) | 0.10 g |
| 6:4 Copolymer of methyl methacrylate and methacrylic acid (average particle size: 1.5 μm) | 0.10 g |
| Silicone Oil SO-1 | 0.030 g |
| Surfactant W-1 | 3.0 mg |
| Surfactant W-2 | 0.030 g |
| Surfactant W-7 | 2.5 mg |

In addition to the above-described compositions, a gelatin hardener H-1 and surfactants W-3, W-4, W-5 and W-6 for coating and emulsification were added to each layer.

Furthermore, phenol, 1,2-benzoisothiazolin-3-one, 2-phenoxyethanol, phenethyl alcohol and p-hydroxybenzoic acid butyl ester as antiseptic or antifungal were added to each layer.

The light-sensitive emulsions used in Sample 101 are shown in Tables 1 and 2.

TABLE 1

Silver Iodobromide Emulsion Used in Sample 101

| Emulsion | Characteristic Features | Equivalent-Sphere Average Grain Size (μm) | Variation Coefficient (%) | AgI Content (%) |
|---|---|---|---|---|
| A | monodisperse tetradecahedral grain | 0.13 | 10 | 4.0 |
| B | monodisperse (100) tabular grain, average aspect ratio: 10 | 0.25 | 12 | 3.8 |
| C | monodisperse (111) tabular grain (internal latent image type), average aspect ratio: 12 | 0.30 | 13 | 3.8 |
| D | monodisperse (111) tabular grain, average aspect ratio: 10 | 0.35 | 17 | 4.8 |
| E | monodisperse (111) tabular grain, average aspect ratio: 3 | 0.40 | 15 | 2.0 |
| F | monodisperse (111) tabular grain, average aspect ratio: 20 | 0.50 | 12 | 1.8 |
| G | monodisperse cubic grain | 0.15 | 9 | 3.5 |
| H | monodisperse (100) tabular grain, average aspect ratio: 10 | 0.24 | 12 | 3.5 |
| I | monodisperse (111) tabular grain, average aspect ratio: 10 | 0.31 | 16 | 3.5 |
| J | monodisperse (111) tabular grain, average aspect ratio: 15 | 0.45 | 16 | 3.0 |
| K | monodisperse (111) tabular grain, average aspect ratio: 20 | 0.60 | 15 | 3.3 |
| L | monodisperse tetradecahedral grain | 0.33 | 10 | 4.5 |
| M | monodisperse (100) tabular grain, average aspect ratio: 11 | 0.33 | 8 | 4.5 |
| N | monodisperse (111) tabular grain, average aspect ratio: 15 | 0.43 | 10 | 2.5 |

TABLE 1-continued

Silver Iodobromide Emulsion Used in Sample 101

| Emulsion | Characteristic Features | Equivalent-Sphere Average Grain Size (μm) | Variation Coefficient (%) | AgI Content (%) |
|---|---|---|---|---|
| O | monodisperse (111) tabular grain, average aspect ratio: 20 | 0.75 | 9 | 2.0 |
| P | monodisperse (111) tabular grain, average aspect ratio: 25 | 0.90 | 8 | 1.8 |

TABLE 2

| Emulsion | Sensitizing Dye Added | Added Amount per 1 mol of Silver Halide (g) |
|---|---|---|
| A | S-1 | 0.26 |
| | S-7 | 0.025 |
| B | S-1 | 0.265 |
| | S-7 | 0.025 |
| C | S-1 | 0.23 |
| | S-7 | 0.025 |
| D | S-1 | 0.205 |
| | S-7 | 0.10 |
| E | S-1 | 0.19 |
| | S-7 | 0.10 |
| F | S-1 | 0.22 |
| | S-7 | 0.025 |
| G | S-5 | 0.35 |
| | S-8 | 0.12 |
| H | S-5 | 0.23 |
| | S-8 | 0.12 |
| I | S-2 | 0.1 |
| | S-5 | 0.29 |
| | S-8 | 0.18 |
| J | S-5 | 0.566 |
| | S-8 | 0.18 |
| K | S-2 | 0.050 |
| | S-5 | 0.34 |
| L | S-3 | 0.25 |
| | S-4 | 0.20 |
| M | S-3 | 0.10 |
| | S-4 | 0.15 |
| | S-6 | 0.25 |
| N | S-4 | 0.25 |
| | S-6 | 0.25 |
| O | S-3 | 0.10 |
| | S-4 | 0.20 |
| | S-6 | 0.25 |
| P | S-3 | 0.050 |
| | S-4 | 0.25 |
| | S-6 | 0.25 |

TABLE 2-continued

| Emulsion | Sensitizing Dye Added | Added Amount per 1 mol of Silver Halide (g) |
|---|---|---|

Note 1) The emulsions all were chemically sensitized using gold, sulfur and selenium.
Note 2) In all of the emulsions, sensitizing dyes were added before the chemical sensitization.
Note 3) In the emulsions, Compounds F-1, F-2, F-3, F-4, F-5, F-6, F-7, F-8, F-9 or F-10 was appropriately added.

(Preparation of Dispersion of Organic Solid Disperse Dye)

Dye E-1 was dispersed in the following manner. To 1,430 g of a dye wet cake containing 30% of water, water and W-4 were added each in an amount of 70 g. This mixture was stirred to form a slurry having a dye concentration of 6%. Thereafter, to Ultravisco Mill (UVM-2) manufactured by Imex, 1,700 ml of zirconia beads having an average particle size of 0.5 mm were filled and the slurry was passed therethrough and pulverized at a peripheral speed of about 10 m/sec with a discharge amount of 0.5 l/min over 8 hours. Thereafter, beads were removed by filtration and the dye particles obtained were heated for the stabilization at 90° C. for 10 hours and then diluted by adding water and gelatin to a dye concentration of 3%. The obtained dye fine particles had an average particle size of 0.60 μm and a particle size distribution width (standard deviation of particle size×10/average particle size) of 18%.

Solid dye dispersions of Dyes E-2 and E-3 were obtained in the same manner. These had an average particle size of 0.54 μm and 0.56 μm, respectively.

(Preparation of Samples 100 and 102 to 108)

Samples 102 to 108 were prepared by replacing only Sensitizing Dye S-1 in Emulsions A to F of Sample 101 to an amount (molar times) shown in Table 3. Also, Dye Blank Sample 100 was prepared by omitting the dyes.

C-1

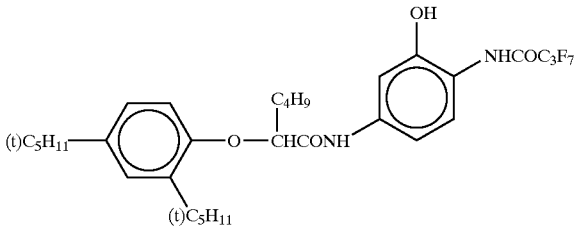

C-2

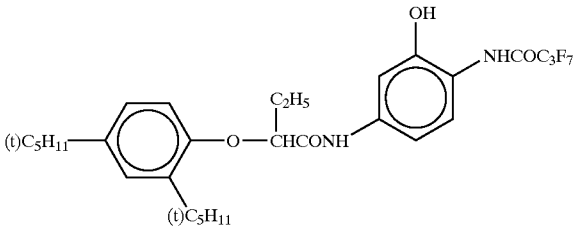

-continued
C-3
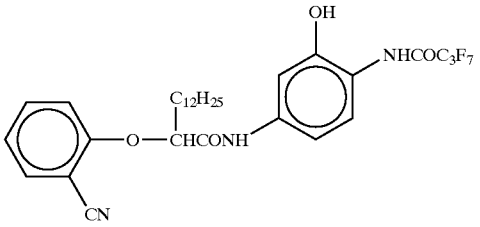
C-4
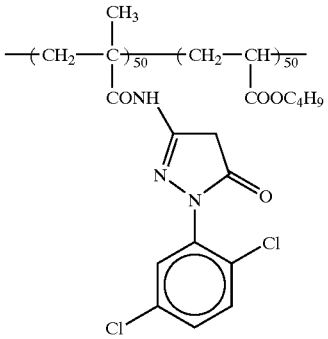
Numerals are wt%.
Average molecular weight:
about 25,000
C-5
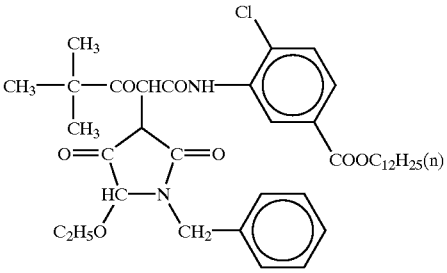
C-6
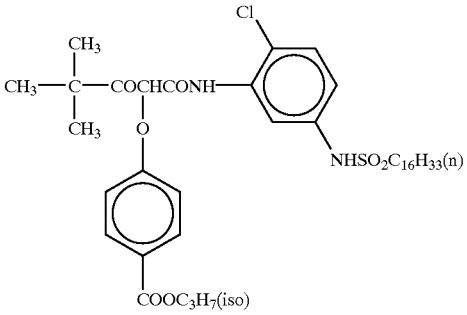
C-7
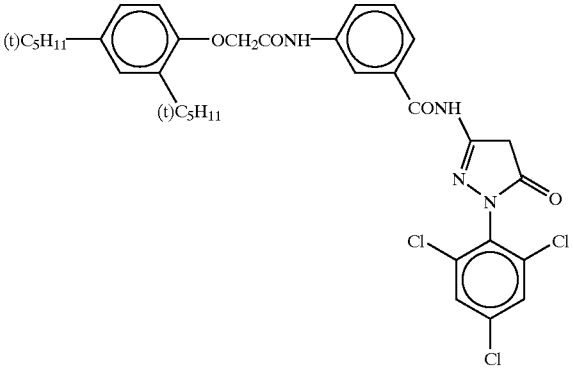
C-8
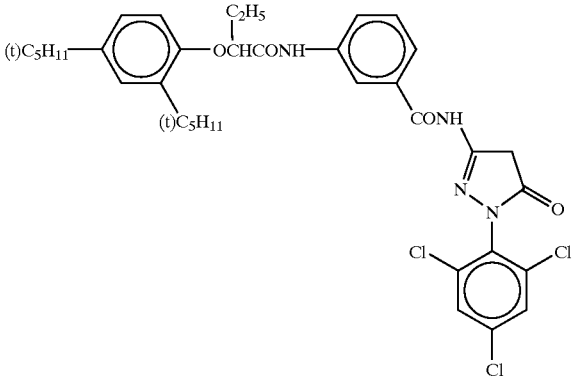
C-9
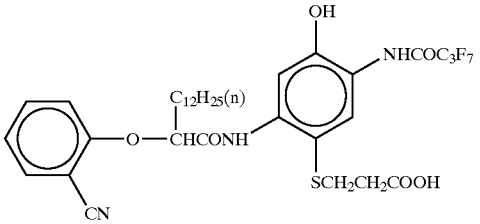
C-10
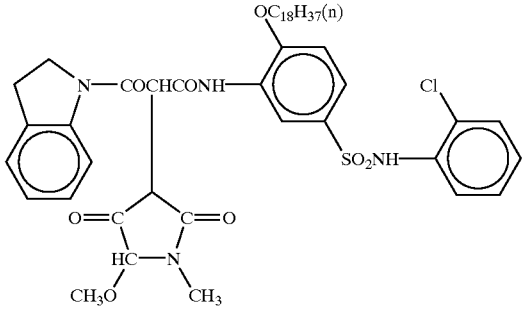

-continued
C-11
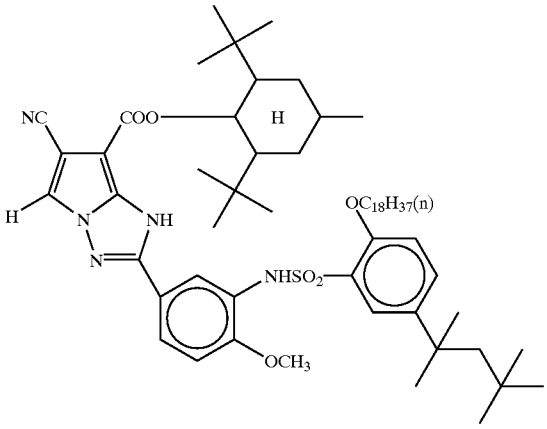
Oil-1
Dibutyl phthalate
Oil-2
Tricresyl phosphate
Oil-3
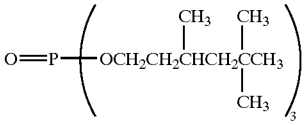
Oil-4
Tricyclohexyl phosphate
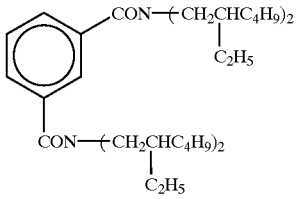
Oil-5
Dicyclohexyl phthalate
Oil-6
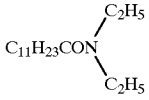
Oil-7
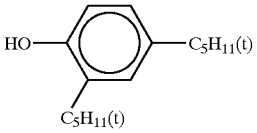
Oil-8
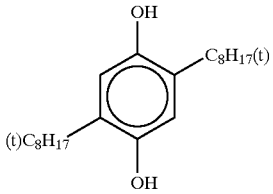
Oil-9
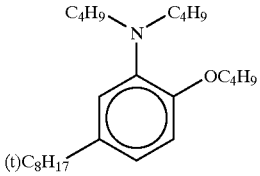
Cpd-A
Cpd-B
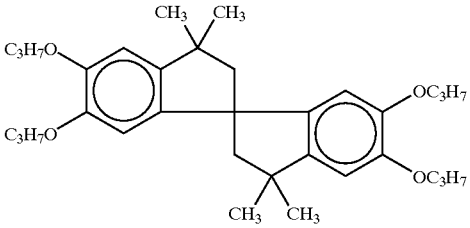
Cpd-C
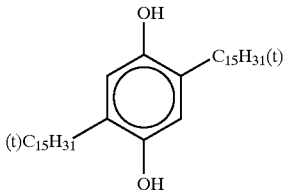
Cpd-D
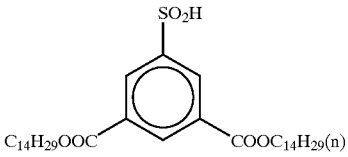

-continued
Cpd-E
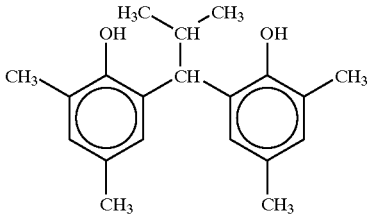
Cpd-G
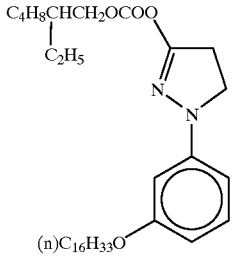
Cpd-F
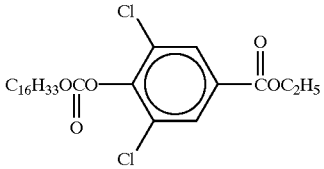
Cpd-H
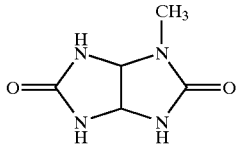
Cpd-I
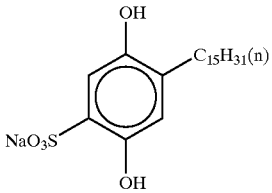
Cpd-J
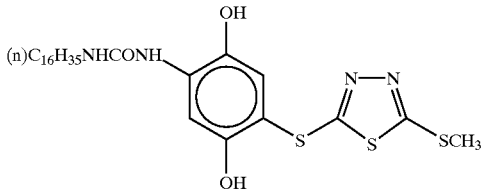
Cpd-K
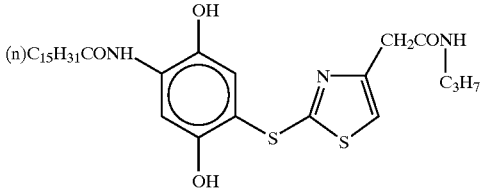
Cpd-L
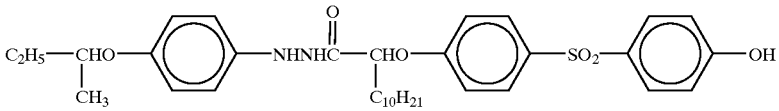
Cpd-M
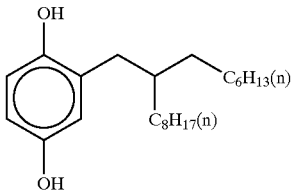
Cpd-N
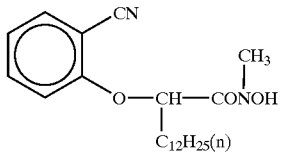
Cpd-O
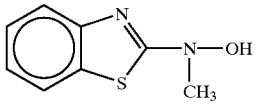
Cpd-P
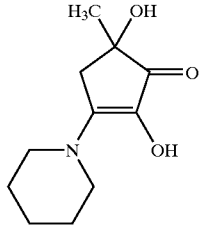
Cpd-Q
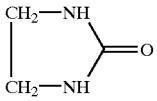
U-1
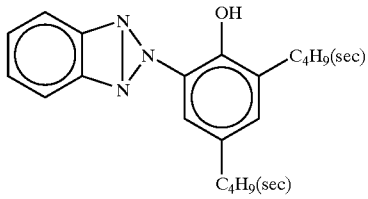

-continued
U-2
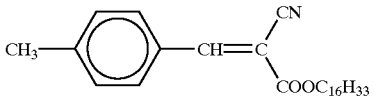
U-3
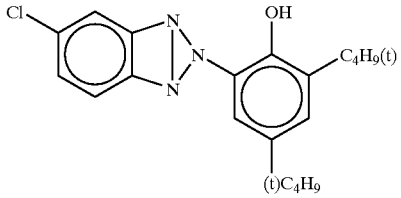
U-4
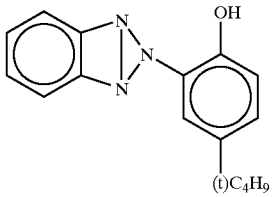
U-5
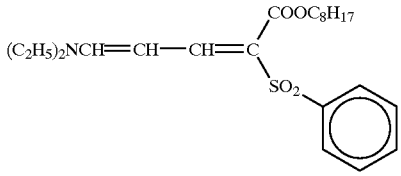
S-1
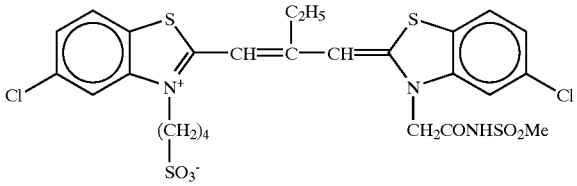
S-2
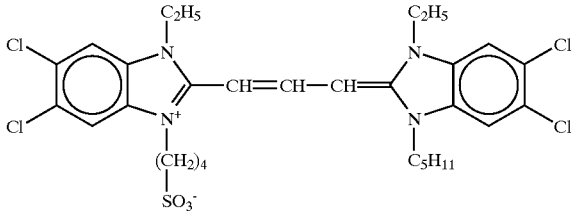
S-3
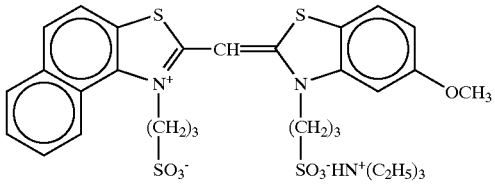
S-4
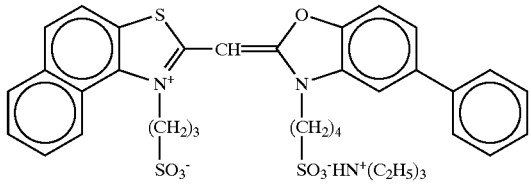
S-5
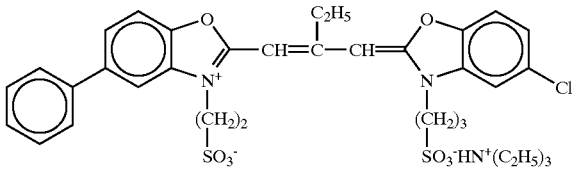
S-6
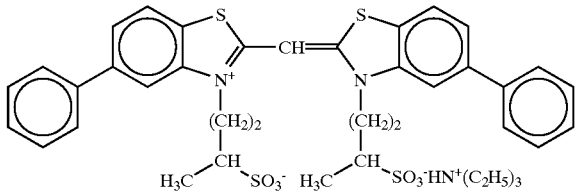
S-7
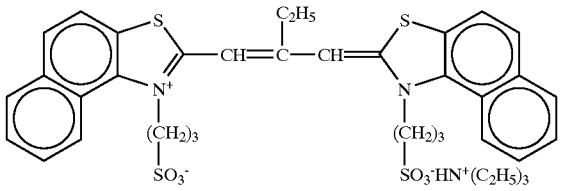
S-8
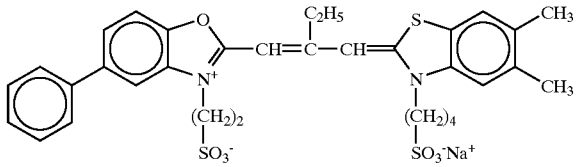
S-9
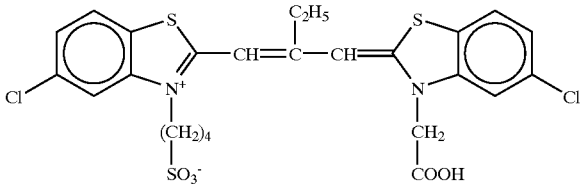
D-1
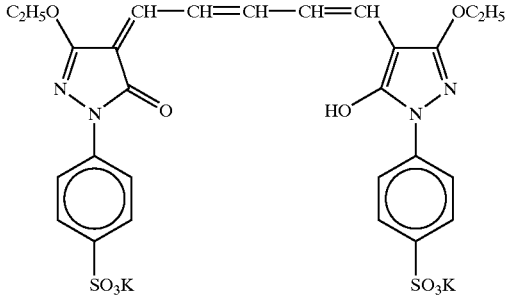

-continued
D-2
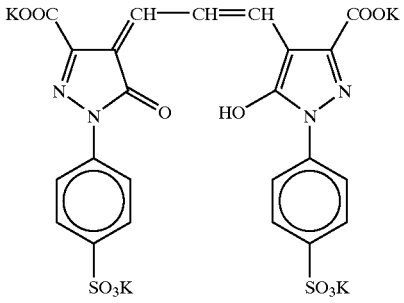
D-3
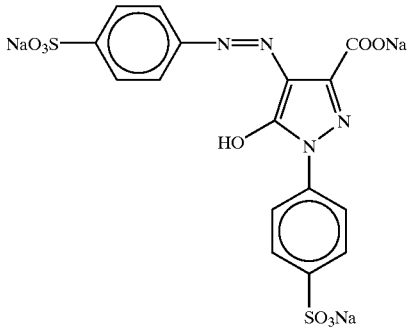
D-4
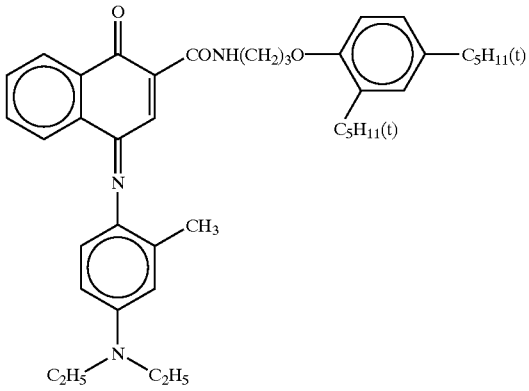
D-5
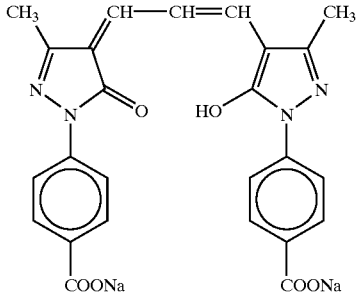
D-6
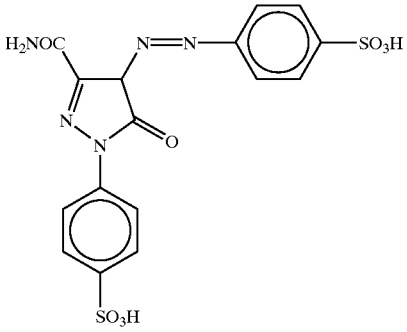
D-7
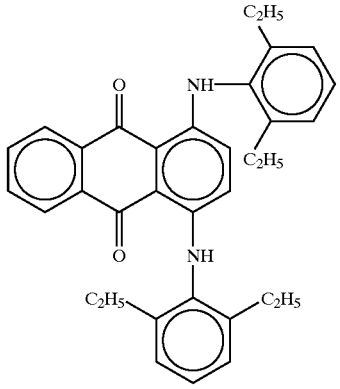
D-8
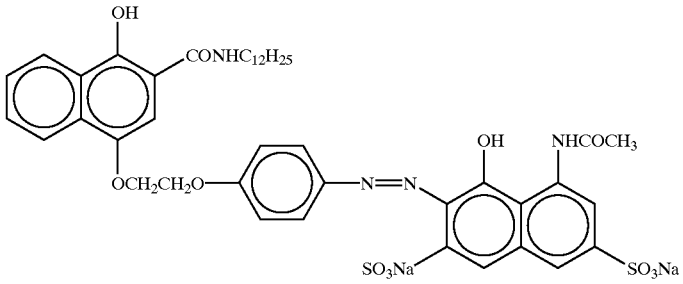
E-1
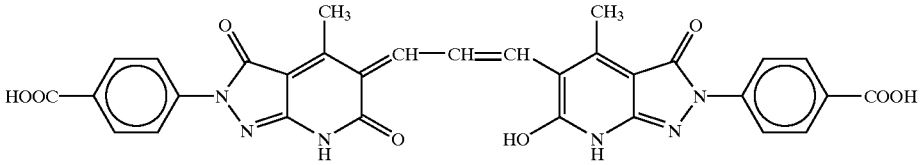

-continued
E-2
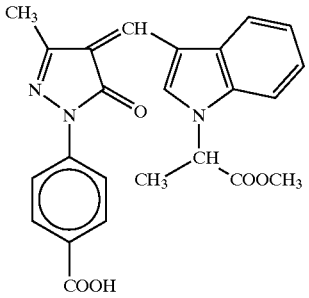
E-3
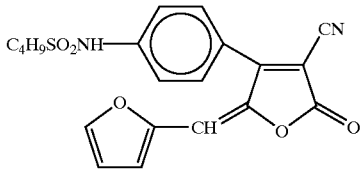
H-1
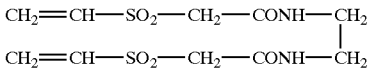
W-1
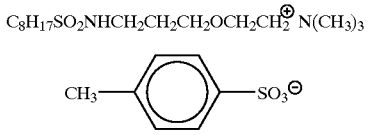
W-2
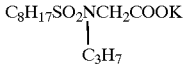
W-3
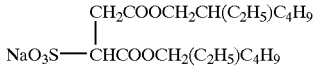
W-4
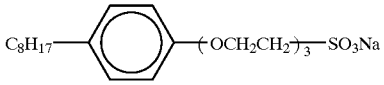
W-5
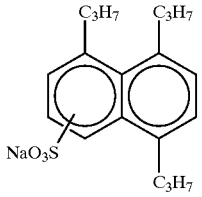
W-6
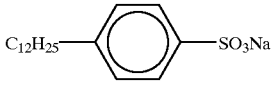
W-7
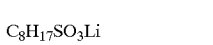
P-1
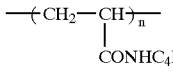
(n = 100~1000)
M-1
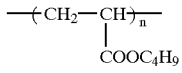
(n = 100~1000)
SO-1
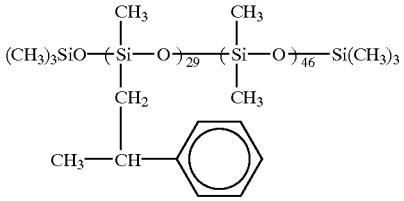
F-1
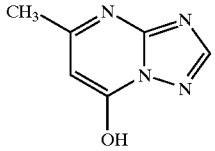
F-2
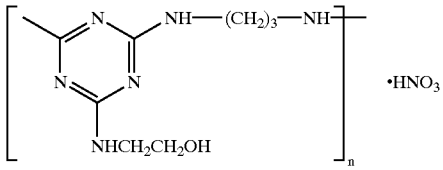
(n = 3~4)
F-3
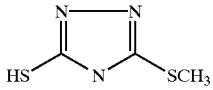
F-4
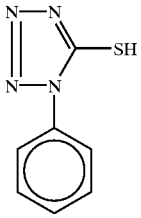
F-5
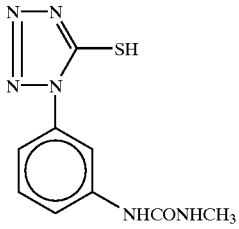

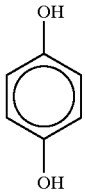

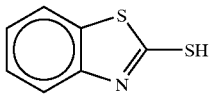

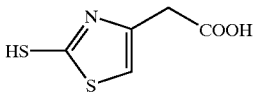

-continued

F-6

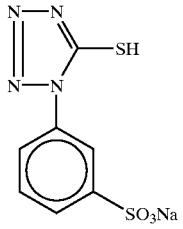

F-7

F-8

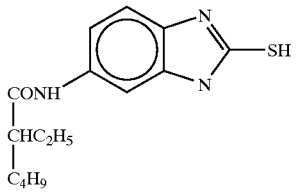

F-9

F-10

(Evaluation of Residual Color and Photographic Property)

The thus-obtained samples each was exposed to white light through a gray wedge for 1/100 second at 20 CMS, processed according to the processing steps shown below, and then subjected to sensitometry. The residual color was evaluated by subtracting the density of magenta stain of Dye Blank Sample 100 from the magenta density in stain of each processed sample. The stain density was measured by a density measuring device, Status A, manufactured by X-RITE. (Processing)

| Processing Step | Time (min) | Temperature (° C.) | Tank Volume (l) | Replenishing Amount (ml/m$^2$) |
|---|---|---|---|---|
| 1st Development | 6 | 38 | 12 | 2,200 |
| 1st Water washing | 2 | 38 | 4 | 7,500 |
| Reversal | 2 | 38 | 4 | 1,100 |
| Color development | 6 | 38 | 12 | 2,200 |
| Pre-bleaching | 2 | 38 | 4 | 1,100 |
| Bleaching | 6 | 38 | 2 | 220 |
| Fixing | 4 | 38 | 8 | 1,100 |
| 2nd Water washing | 4 | 38 | 8 | 7,500 |
| Final Rinsing | 1 | 25 | 2 | 1,100 |

Each Processing Solution had the Following Composition.

(1st Developer)

| | Tank Solution | Re-plenisher |
|---|---|---|
| Nitrilo-N,N,N-trimethylene phosphonic acid pentasodium salt | 1.5 g | 1.5 g |
| Diethylenetriaminepentaacetic acid pentasodium salt | 2.0 g | 2.0 g |
| Sodium sulfite | 30 g | 30 g |
| Potassium hydroquinone monosulfonate | 20 g | 20 g |
| Potassium carbonate | 15 g | 20 g |
| Sodium bicarbonate | 12 g | 15 g |
| 1-Phenyl-4-methyl-4-hydroxymethyl-3-pyrazolidone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethylene glycol | 13 g | 15 g |
| Water to make | 1000 ml | 1000 ml |
| pH | 9.60 | 9.60 |

The pH was adjusted with sulfuric acid or potassium hydroxide.

(Reversal Solution)

| | Tank Solution | Replenisher |
|---|---|---|
| Nitrilo-N,N,N-trimethylene phosphonic acid pentasodium salt | 3.0 g | same as tank solution |
| Stannous chloride dihydrate | 1.0 g | |
| p-Aminophenol | 0.1 g | |
| Sodium hydroxide | 8 g | |
| Glacial acetic acid | 15 ml | |
| Water to make | 1000 ml | |
| pH | 6.00 | |

The pH was adjusted with acetic acid or sodium hydroxide.

(Color Developer)

| | Tank Solution | Re-plenisher |
|---|---|---|
| Nitrilo-N,N,N-trimethylene phosphonic acid pentasodium salt | 2.0 g | 2.0 g |
| Sodium sulfite | 7.0 g | 7.0 g |
| Phosphoric acid trisodium dodecahydrate | 36 g | 36 g |
| Potassium bromide | 1.0 g | — |
| Potassium iodide | 90 mg | — |

-continued

| | Tank Solution | Re-plenisher |
|---|---|---|
| Sodium hydroxide | 3.0 g | 3.0 g |
| Citrazinic acid | 1.5 g | 1.5 g |
| N-Ethyl-N-(β-methaneslfonamido-ethyl)-3-methyl-4-aminoaniline 3/2 sulfuric acid monohydrate | 11 g | 11 g |
| 3,6-Dithiaoctane-1,8-diol | 1.0 g | 1.0 g |
| Water to make | 1000 ml | 1000 ml |
| pH | 11.80 | 12.00 |

The pH was adjusted with sulfuric acid or potassium hydroxide.

(Pre-Bleaching Solution)

| | Tank Solution | Re-plenisher |
|---|---|---|
| Ethylenediaminetetraacetic acid disodium salt dihydrate | 8.0 g | 8.0 g |
| Sodium sulfite | 6.0 g | 8.0 g |
| 1-Thioglycerol | 0.4 g | 0.4 g |
| Formaldehyde sodium bisulfite adduct | 30 g | 35 g |
| Water to make | 1000 mg | 1000 ml |
| pH | 6.30 | 6.10 |

The pH was adjusted with acetic acid or sodium hydroxide.

(Bleaching Solution)

| | Tank Solution | Re-plenisher |
|---|---|---|
| Ethylenediaminetetraacetic acid disodium salt dihydrate | 2.0 g | 4.0 g |
| Ethylenediaminetetraacetic acid Fe(III) ammonium dihydrate | 120 g | 240 g |
| Potassium bromide | 100 g | 200 g |
| Ammonium nitrate | 10 g | 20 g |
| Water to make | 1000 ml | 1000 ml |
| pH | 5.70 | 5.50 |

The pH was adjusted with nitric acid or sodium hydroxide.

(Fixing Solution)

| | Tank Solution | Replenisher |
|---|---|---|
| Ammonium thiosulfate | 80 g | Same as tank solution |
| Sodium sulfite | 5.0 g | Same as tank solution |
| Sodium bisulfite | 5.0 g | Same as tank solution |
| Water to make | 1000 ml | 1000 ml |
| pH | 6.60 | |

The pH was adjusted with acetic acid or aqueous ammonia.

(Stabilizing Solution)

| | Tank Solution | Re-plenisher |
|---|---|---|
| 1,2-Benzoisothiazolin-3-one | 0.02 g | 0.03 g |
| Polyoxyethylene-p-monononylphenyl ether (average polymerization degree: 10) | 0.3 g | 0.3 g |
| Polymaleic acid (average molecular weight: 2,000) | 0.1 g | 0.15 g |
| Water to make | 1000 ml | 1000 ml |
| pH | 7.0 | 7.0 |

The evaluation results of the sensitometry and residual color are shown in Table 3 below. The relative sensitivity RL was compared based on the relative exposure amount necessary for giving a density 1.0 larger than the minimum density.

TABLE 3

| Sample No. | Dye | $\pi_v$ | $\pi_w$ | Dye amount (molar times) | RL, relative sensitivity | Magenta Residual Color Density | Remarks |
|---|---|---|---|---|---|---|---|
| 100 | none | | | | | 0 (control) | Blank |
| 101 | S-1 | 0.71 | 0.71 | ×1 | 100 | 0.062 | Comparison |
| 102 | S-9 | 0.71 | 0.71 | ×1.1 | 98 | 0.058 | Comparison |
| 103 | I-11 | 0.71 | 0.14 | ×1.2 | 105 | 0.040 | Invention |
| 104 | I-16 | 0.14 | 0.14 | ×1.3 | 100 | 0.031 | Invention |
| 105 | II-1 | 0.14 | 0.71 | ×1.2 | 113 | 0.028 | Invention |
| 106 | II-2 | 0.71 | 0.00 | ×1.2 | 108 | 0.020 | Invention |
| 107 | III-1 | 0.14 | 0.71 | ×1 | 101 | 0.018 | Invention |
| 108 | III-1 | 0.14 | 0.71 | ×1.2 | 115 | 0.025 | Invention |

As is apparent from the results in Table 3, by using compound of the present invention, a light-sensitive material reduced in the residual color and having high sensitivity can be obtained. Thus, it is clearly verified that by virtue of the construction of the present invention, both high sensitivity and reduced residual color can be first attained.

By the construction of the present invention, a silver halide photographic light-sensitive material having high sensitivity and reduced in the residual color can be obtained.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having provided thereon at least one emulsion layer containing silver halide grains, which comprises at least one compound represented by the following formula (I):

(I)

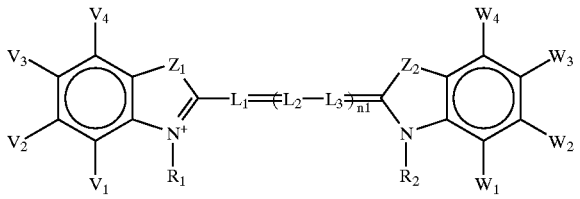

$(M)_m$ wherein $Z_1$ and $Z_2$ each represents an oxygen atom, a sulfur atom, a selenium atom, a tellurium atom or a NR group, R represents an alkyl group, an aryl group or a heterocyclic group, $L_1$, $L_2$ and $L_3$ each represents a methine group, $n_1$ represents 0, 1, 2 or 3, $V_1$, $V_2$, $V_3$, $V_4$, $W_1$, $W_2$, $W_3$ and $W_4$ each represents a hydrogen atom or a substituent, provided that two substituents may be combined with each other to form a condensed ring on the condition that assuming the sum total of π values of the substituents $V_1$ to $V_4$ is $\pi_v$ and the sum total of π values of the substituents $W_1$ to $W_4$ is $\pi_w$, either one of $\pi_v$ and $\pi_w$ is 0.70 or less and the other is 0.70 or more, M represents a charge-balancing counter ion, m represents a number necessary for neutralizing the electric charge of the molecule, $R_1$ represents an alkyl group, an aryl group or a heterocyclic group, and $R_2$ represents a substituent represented by the following formula:

$$-(L_e)_{ke}COOH$$

wherein $L_e$ represents a methylene group, and $k_e$ represents an integer of 1 or more.

2. The silver halide photographic light-sensitive material as claimed in claim 1, wherein $\pi_v$ is 0.70 or less and $\pi_w$ is 0.70 or more.

3. The silver halide photographic light-sensitive material as claimed in claim 2, wherein $\pi_v$ is from 0.00 to 0.70 and $\pi_w$ is 0.70 to 1.40.

4. The silver halide photographic light-sensitive material as claimed in claim 1, wherein the compound represented by formula (I) is a compound represented by the following formula (II):

(II)

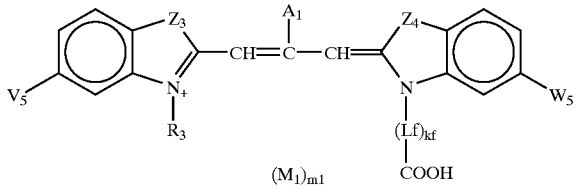

$(M_1)_{m1}$ wherein $Z_3$ and $Z_4$ each represents oxygen atom or sulfur atom, $A_1$ represents hydrogen atom or an alkyl group, either one of $V_5$ and $W_5$ is a substituent selected from the group consisting of chlorine atom, bromine atom, iodine atom, a trifluoromethyl group, an ethyl group, a benzoyl group and a 1-pyrrolyl group, and the other is a substituent selected from the group consisting of hydrogen atom, fluorine atom, a methyl group, a methylthio group, an ethoxy group, an ethoxycarbonyl group, a 2-pyridyl group and a 4-pyridyl group, M1 represents a charge-balancing counter ion, $m_1$ represents a number necessary for neutralizing the electric charge of the molecule, $R_3$ represents an alkyl group having a sulfo group as a substituent, $L_f$ represents a methylene group, and $k_f$ represents an integer of from 1 to 3.

5. A silver halide photographic light-sensitive material comprising a support having provided thereon at least one emulsion layer containing silver halide grains, which comprises at least one compound represented by the following formula (I)

(I)

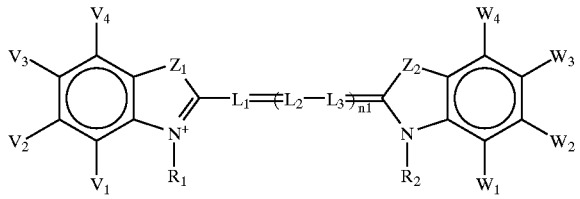

$(M)_m$ wherein $Z_1$ and $Z_2$ each represents oxygen atom, sulfur atom, selenium atom, tellurium atom or a >NR group, R represents an alkyl group, an aryl group or a heterocyclic group, $L_1$, $L_2$ and $L_3$ each represents a methine group, $n_1$ represents 0, 1, 2 or 3, $V_1$, $V_2$, $V_3$, $V_4$, $W_1$, $W_2$, $W_3$ and $W_4$ each represents hydrogen atom or a substituent, provided that two substituents may be combined with each other to form a condensed ring on the condition that assuming the sum total of π values of the substituents $V_1$ to $V_4$ is $\pi_v$, and the sum total of π values of the substituents $W_1$ to $W_4$ is $\pi_w$, $\pi_v$ is from 0.00 to 0.70 and $\pi_w$ is from 0.70 to 1.40, M represents a charge-balancing counter ion, m represents a number necessary for neutralizing the electric charge of the molecule, $R_1$ represents an alkyl group, an aryl group or a heterocyclic group, and $R_2$ represents a substituent represented by any one of the following formulae:

$$-(L_a)_{ka}CONHSO_2R_a$$

$$-(L_b)_{kb}SO_2NHCOR_b$$

$$-(L_c)_{kc}CONHCOR_c$$

$$-(L_d)_{kd}SO_2NHSO_2R_d$$

wherein $R_a$, $R_b$, $R_c$ and $R_d$ each represents an alkyl group, an aryl group, a heterocyclic group, an alkoxy group, an aryloxy group, a heterocyclyloxy group or an amino group, $L_a$, $L_b$, $L_c$, and $L_d$ each represents a methylene group, and $k_a$, $k_b$, $k_c$ and $k_d$ each represents an integer of 1.

6. The silver halide photographic light-sensitive material, as claimed in claim 5, wherein the compound represented by formula (I) is a compound represented by the following formula (III):

(III)

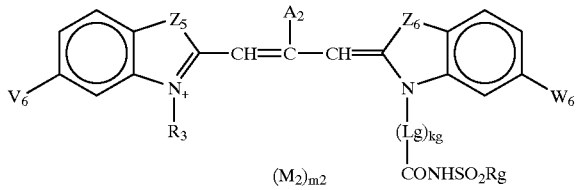

$(M_2)_{m2}$ wherein $Z_5$ and Z6 each represents oxygen atom or sulfur atom, $A_2$ represents hydrogen atom or an alkyl group, $V_6$ represents a substituent selected from the group consisting of hydrogen atom, fluorine atom. a methyl group, a methylthio group, an ethoxy group, an ethoxycarbonyl group, a 2-pyridyl group and a 4-pyridyl group, $W_6$ represents a substituent selected from the group consisting of chlorine atom, bromine atom, iodine atom, a trifluoromethyl group, an ethyl group, a benzoyl group and a 1-pyrrolyl group, $M_2$ represents a charge-balancing counter ion, $m_2$ represents a number necessary for neutralizing the electric charge of the molecule, $R_4$ represents an alkyl group having a sulfo group as a substituent, $R_g$ represents an alkyl group, $L_g$ represents a methylene group, and $k_g$ represents an integer of 1.

7. The silver halide photographic light-sensitive material as claimed in claim 1, 2, 3, 4, 5, or 6, wherein at least one compound represented by formula (I) (II) or (III) is contained and the emulsion layer containing said compound is formed of silver halide grains having an average aspect ratio of from 3 to 100.

* * * * *